US007472541B2

(12) United States Patent
Takeda et al.

(10) Patent No.: US 7,472,541 B2
(45) Date of Patent: Jan. 6, 2009

(54) COMPRESSOR CONTROL UNIT AND GAS TURBINE POWER PLANT INCLUDING THIS UNIT

(75) Inventors: Kazuhiro Takeda, Hiroshima (JP); Kazuko Takeshita, Hiroshima (JP); Makoto Tsutsui, Hiroshima (JP); Hiroaki Yoshida, Hiroshima (JP); Kengo Hirano, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 599 days.

(21) Appl. No.: 11/267,165

(22) Filed: Nov. 7, 2005

(65) Prior Publication Data

US 2006/0101824 A1 May 18, 2006

(30) Foreign Application Priority Data

Nov. 17, 2004 (JP) ..... 2004-332622

(51) Int. Cl.
*F02C 3/22* (2006.01)
*F02C 7/00* (2006.01)

(52) U.S. Cl. ..... 60/39.465; 415/17; 417/18

(58) Field of Classification Search ..... 60/39.465, 60/726, 727, 734; 415/17, 28, 49; 417/18, 417/302

See application file for complete search history.

(56) References Cited

U.S. PATENT DOCUMENTS 4,949,276 A * 8/1990 Staroselsky et al. ..... 415/17
5,242,263 A * 9/1993 Mondoloni ..... 415/28
5,306,116 A * 4/1994 Gunn et al. ..... 415/17

FOREIGN PATENT DOCUMENTS

JP 3137498 B2 12/2000

* cited by examiner

*Primary Examiner*—Louis J Casaregola
(74) *Attorney, Agent, or Firm*—Birch, Stewart, Kolasch & Birch, LLP

(57) ABSTRACT

Provided is a compressor control unit with a high response ability to changes of gas condition of a compressor (compressor suction temperature, pressure, gas specific gravity, pressure ratio of suction pressure and discharge pressure). In the control unit for a compressor that supplies gas into a gas turbine through a header tank, an inlet gas condition is measured and a load command value from a gas turbine controller is corrected to be increased or decreased corresponding to the measured inlet gas condition.

26 Claims, 11 Drawing Sheets

COMPRESSOR CONTROL UNIT AND GAS TURBINE POWER PLANT INCLUDING THIS UNIT

BACKGROUND OF THE INVENTION

1. Field of the Invention

The present invention relates to a control unit of a compressor compressing gas and also relates to a gas turbine power plant comprising this compressor control unit.

2. Description of Related Art

Conventionally, there is known a gas turbine fuel gas supply utility comprising a control system for adjusting a fuel gas flow rate to be supplied into a gas turbine so that a discharge pressure of a fuel gas compressor is maintained within a set range, as proposed by Patent Document 1 mentioned below, for example. This control method comprises a PI (proportional and integral) controller and two function blocks. First, the PI controller calculates a manipulation value (MV) for a by-pass valve opening. If the discharge pressure is lower than a set value, the PI controller makes the by-pass valve opening smaller. And if the discharge pressure is higher than the set value, the PI controller makes the by-pass valve opening bigger. Next, the first function block receives the manipulation value which is calculated by the gas turbine speed governing valve controller based on the gas turbine speed, and adjusts the valve opening of the governing valve located on the fuel gas piping to the gas turbine.

The first function block calculates the manipulation value such that the more the first function hock opens the governing valve, the more the fuel gas flows. The second function block receives this manipulation value as an input signal and outputs a manipulation value to make the opening of the by-pass valve smaller with the fuel gas consumption rate becoming larger, as an output signal to be added to the by-pass valve manipulation signal.

(Patent Document 1) Japanese Patent No. 3137498

Nevertheless, there are actually various condition changes in the fuel gas to be supplied, such as due to the kind of fuel gas supply source (gas well or gas tank), whether there are other gas-using plants connected in parallel to the fuel gas supply source or not and a gas-using condition thereof, temperature changes according to the season, day or night, etc. In the conventional compressor control units, a gas condition of the fuel gas to be supplied into the compressor (compressor suction temperature, pressure and gas specific gravity, differential pressure between the suction side and the discharge side) is not necessarily taken into consideration so as to correspond to these changes and there is a problem that a response ability as a fuel gas supply utility is not sufficient.

SUMMARY OF THE INVENTION

In view of the problem of the conventional compressor control units, it is an object of the present invention to provide a compressor control unit with a high response ability to the changes of the gas condition (compressor suction temperature, pressure and gas specific gravity, differential pressure between the suction side and the discharge side).

In order to achieve the above-mentioned object, the present invention provides the following means (1) to (26):

(1) As a first means of the present invention, a compressor control unit for controlling a compressor that supplies gas into a header tank comprises: a pressure setter setting a pressure of the header tank; a pressure controller comparing a supply pressure measured value measured by a header tank pressure indicator that detects a pressure in the header tank with a supply pressure set value set by the pressure setter to thereby calculate a pressure manipulation value corresponding to a differential pressure as the result of the comparison; a compression condition corrector measuring a compression condition of the gas and making a correction, corresponding to a measured value as the result of the measurement, to increase or decrease a load command value inputted from outside to thereby calculate a corrected load command value; a command value function generator being inputted with the corrected load command value calculated by the compression condition corrector to thereby calculate a valve manipulation value; an opening command adder adding the pressure manipulation value as a correction manipulation value and the valve manipulation value calculated by the command value function generator to thereby calculate a valve manipulation correction value; a flow control function generator being inputted with the valve manipulation correction value calculated by the opening command adder to thereby calculate a flow control opening command value that increases with an increase of the valve manipulation correction value if the valve manipulation correction value is a predetermined value or more and put out this flow control opening command value as a manipulation signal into an inlet flow control means of the compressor; and a recycle valve function generator receiving the valve manipulation correction value calculated by the opening command adder to thereby calculate a recycle valve opening command value that decreases with the increase of the valve manipulation correction value if the valve manipulation correction value is less than the predetermined value and generate a control signal of a recycle valve located in a recycle line connecting between a suction side and a discharge side of the compressor.

(2) As a second means of the present invention, in the compressor control unit as mentioned in (1) above, the compression condition of the gas is measured by an inlet gas temperature indicator provided on an inlet side of the compressor and the compression condition corrector increases or decreases the load command value based on an inlet temperature measured value measured by the inlet gas temperature indicator to thereby calculate the corrected load command value.

(3) As a third means of the present invention, in the compressor control unit as mentioned in (1) above, the compression condition of the gas is measured by a gas specific gravity meter provided on an inlet side of the compressor and the compression condition corrector increases or decreases the load command value based on a specific gravity measured value of the gas measured by the gas specific gravity meter to thereby calculate the corrected load command value.

(4). As a fourth means of the present invention, in the compressor control unit as mentioned in (1) above, the compression condition of the gas is measured by an inlet gas pressure indicator provided on an inlet side of the compressor and an outlet gas pressure indicator provided on an outlet side of the compressor and the compression condition corrector increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(5) As a fifth means of the present invention, in the compressor control unit as mentioned in (1) above, the compression condition of the gas is measured by an inlet gas temperature indicator and a gas specific gravity meter both provided on an inlet side of the compressor and the compression condition corrector increases or decreases the load command value based on an inlet temperature measured value measured by the inlet gas temperature indicator as well as increases or decreases the load command value based on a specific gravity measured value of the gas measured by the gas specific gravity meter to thereby calculate the corrected load command value.

(6) As a sixth means of the present invention, in the compressor control unit as mentioned in (1) above, the compression condition of the gas is measured by an inlet gas temperature indicator and an inlet gas pressure indicator both provided on an inlet side of the compressor as well as is measured by an outlet gas pressure indicator provided on an outlet side of the compressor and the compression condition corrector increases or decreases the load command value based on an inlet temperature measured value measured by the inlet gas temperature indicator and increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(7) As a seventh means of the present invention, in the compressor control unit as mentioned in (1) above, the compression condition of the gas is measured by a gas specific gravity meter and an inlet gas pressure indicator both provided on an inlet side of the compressor as well as is measured by an outlet gas pressure indicator provided on an outlet side of the compressor and the compression condition corrector increases or decreases the load command value based on a specific gravity measured value of the gas measured by the gas specific gravity meter and increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(8) As an eighth means of the present invention, in the compressor control unit as mentioned in (1) above, the compression condition of the gas is measured by an inlet gas temperature indicator, an inlet gas pressure indicator and a gas specific gravity meter all provided on an inlet side of the compressor as well as is measured by an outlet gas pressure indicator provided on an outlet side of the compressor and the compression condition corrector increases or decreases the load command value based on an inlet temperature measured value measured by the inlet gas temperature indicator, increases or decreases the load command value based on an inlet pressure measured value measured by the inlet gas pressure indicator and increases or decreases the load command value based on a specific gravity measured value of the gas measured by the gas specific gravity meter as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(9) As a ninth means of the present invention, in the compressor control unit as mentioned in any one of (1) to (8) above, the compressor control unit further comprises an adder adding the pressure manipulation value inputted from the pressure controller and a supply flow rate measured value measured by a supply line flow meter to thereby put out a pressure manipulation correction value as well as comprises a flow controller calculating the correction manipulation value corresponding to a difference between the pressure manipulation correction value and a tank supply flow rate measured value measured by a header tank supply line flow meter and the opening command adder adds the valve manipulation value calculated by the command value function generator and the correction manipulation value inputted from the flow controller to thereby calculate the valve manipulation value.

(10) As a tenth means of the present invention, in the compressor control unit as mentioned in any one of (1) to (8) above, the inlet flow control means is an inlet guide vane provided at an inlet of the compressor.

(11) As an eleventh means of the present invention, in the compressor control unit as mentioned in any one of (1) to (8) above, the inlet flow control means is a speed controller of a driver that rotationally drives the compressor.

(12) As a twelfth means of the present invention, in the compressor control unit as mentioned in (9) above, the inlet flow control means is an inlet guide vane provided at an inlet of the compressor.

(13) As a thirteenth means of the present invention, in the compressor control unit as mentioned in (9) above, the inlet flow control means is a speed controller of a driver that rotationally drives the compressor.

(14) As a fourteenth means of the present invention, a gas turbine power plant comprises; a gas supply line connected to a gas supply source, a compressor suction line connected to the gas supply line, an inlet guide vane located in the compressor suction line, a compressor having its inlet side connected to the compressor suction line, a driver driving the compressor, a compressor discharge line connected to an outlet side of the compressor, a recycle line connecting the compressor discharge line and the gas supply line, a recycle valve located in the recycle line, a header tank supply line connected to the compression discharge line, a header tank having its inlet side connected to the header tank supply line, a gas turbine supply line connected to an outlet side of the header tank, a gas turbine connected to the gas turbine supply line for driving a generator, and a compressor control unit controlling the compressor.

This compressor control unit comprises; a pressure setter setting a pressure of the header tank; a pressure controller comparing a supply pressure measured value measured by a header tank pressure indicator that detects a pressure in the header tank with a supply pressure set value set by the pressure setter to thereby calculate a pressure manipulation value corresponding to a differential pressure as the result of the comparison; a compression condition corrector measuring a compression condition of the gas and making a correction, corresponding to a measured value as the result of the measurement, to increase or decrease a load command value inputted from outside to thereby calculate a corrected load command value; a command value function generator being inputted with the corrected load command value calculated by the compression condition corrector to thereby calculate a valve manipulation value; an opening command adder adding the pressure manipulation value as a correction manipulation value and the valve manipulation value calculated by the command value function generator to thereby calculate a valve manipulation correction value; a flow control function generator being inputted with the valve manipulation correction value calculated by the opening command adder to thereby calculate a flow control opening command value that increases with an increase of the valve manipulation correction value if the valve manipulation correction value is a predetermined value or more and put out this flow control opening command value as a manipulation signal into an inlet flow control means of the compressor; and a recycle valve function generator receiving the valve manipulation correction value calculated by the opening command adder to thereby calculate a recycle valve opening command value that decreases with the increase of the valve manipulation correction value if the valve manipulation correction value is less than the predetermined value and generate a control signal of the recycle valve located in the recycle line connecting between a suction side and a discharge side of the compressor.

(15) As a fifteenth means of the present invention, in the gas turbine power plant as mentioned in (14) above, the compression condition of the gas is measured by an inlet gas temperature indicator provided on an inlet side of the compressor and the compression condition corrector increases or decreases the load command value based on an inlet temperature measured value measured by the inlet gas temperature indicator to thereby calculate the corrected load command value.

(16) As a sixteenth means of the present invention, in the gas turbine power plant as mentioned in (14) above, the compression condition of the gas is measured by a gas specific gravity meter provided on an inlet side of the compressor and the compression condition corrector increases or decreases the load command value based on a specific gravity measured value of the gas measured by the gas specific gravity meter to thereby calculate the corrected load command value.

(17) As a seventeenth means of the present invention, in the gas turbine power plant as mentioned in (14) above, the compression condition of the gas is measured by an inlet gas pressure indicator provided on an inlet side of the compressor and an outlet gas pressure indicator provided on an outlet side of the compressor and the compression condition corrector increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(18) As an eighteenth means of the present invention, in the gas turbine power plant as mentioned in (14) above, the compression condition of the gas is measured by an inlet gas temperature indicator and a gas specific gravity meter both provided on an inlet side of the compressor and the compression condition corrector increases or decreases the load command value based on an inlet temperature measured value measured by the inlet gas temperature indicator as well as increases or decreases the load command value based on a specific gravity measured value of the gas measured by the gas specific gravity meter to thereby calculate the corrected load command value.

(19) As a nineteenth means of the present invention, in the gas turbine power plant as mentioned in (14) above, the compression condition of the gas is measured by an inlet gas temperature indicator and an inlet gas pressure indicator both provided on an inlet side of the compressor as well as is measured by an outlet gas pressure indicator provided on an outlet side of the compressor and the compression condition corrector increases or decreases the load command value based on an inlet temperature measured value measured by the inlet gas temperature indicator and increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(20) As a twentieth means of the present invention, in the gas turbine power plant as mentioned in (14) above, the compression condition of the gas is measured by a gas specific gravity meter and an inlet gas pressure indicator both provided on an inlet side of the compressor as well as is measured by an outlet gas pressure indicator provided on an outlet side of the compressor and the compression condition corrector increases or decreases the load command value based on a specific gravity measured value of the gas measured by the gas specific gravity meter and increases or decreases the load command value based on an inlet pressure measured value measured by the inlet gas pressure indicator as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(21) As a twenty-first means of the present invention, in the gas turbine power plant as mentioned in (14) above, the compression condition of the gas is measured by an inlet gas temperature indicator, an inlet gas pressure indicator and a gas specific gravity meter all provided on an inlet side of the compressor as well as is measured by an outlet gas pressure indicator provided on an outlet side of the compressor and the compression condition corrector increases or decreases the load command value based on an inlet temperature measured value measured by the inlet gas temperature indicator, increases or decreases the load command value based on an inlet pressure measured value measured by the inlet gas pressure indicator and increases or decreases the load command value based on a specific gravity measured value of the gas measured by the gas specific gravity meter as well as increases or decreases the load command value based on a pressure ratio of the inlet pressure measured value measured by the inlet gas pressure indicator and an outlet pressure measured value of the gas measured by the outlet gas pressure indicator to thereby calculate the corrected load command value.

(22) As a twenty-second means of the present invention, in the gas turbine power plant as mentioned in any one of (14) to (21) above, the compressor control unit further comprises an adder adding the pressure manipulation value inputted from the pressure controller and a supply flow rate measured value measured by a supply line flow meter to thereby put out a pressure manipulation correction value as well as comprises a flow controller calculating the correction manipulation value corresponding to a difference between the pressure manipulation correction value and a tank supply flow rate measured value measured by a header tank supply line flow meter and the opening command adder adds the valve manipulation value calculated by the command value function generator and the correction manipulation value inputted from the flow controller to thereby calculate the valve manipulation correction value.

(23) As a twenty-third means of the present invention, in the gas turbine power plant as mentioned in any one of (14) to (21) above, the inlet flow control means is an inlet guide vane provided at an inlet of the compressor.

(24) As a twenty-fourth means of the present invention, in the gas turbine power plant as mentioned in any one of (14) to (21) above, the inlet flow control means is a speed controller of the driver that rotationally drives the compressor.

(25) As a twenty-fifth means of the present invention, in the gas turbine power plant as mentioned in (22) above, the inlet flow control means is an inlet guide vane provided at an inlet of the compressor.

(26) As a twenty-sixth means of the present invention, in the gas turbine power plant as mentioned in (22) above, the inlet flow control means is a speed controller of the driver that rotationally drives the compressor.

According to the present invention comprising the means of (1) to (26) mentioned above and claimed in claims as appended herein, the gas compression condition (at least one of the compressor suction temperature, pressure, gas specific gravity and differential pressure between the suction pressure and the discharge pressure) is measured and the load command value inputted from outside is corrected to be increased or decreased corresponding to the measured value. Thereby, a controllability of the compressor control unit to the changes of the gas condition can be appropriately improved.

BRIEF DESCRIPTION OF THE DRAWINGS

FIG. 2 is a detailed block diagram of a gas condition corrector of FIG. 1, wherein

DESCRIPTION OF THE PREFERRED EMBODIMENTS

Embodiments about the present invention will be described with reference to FIGS. 1 to 16 as follows.

Figure 1:
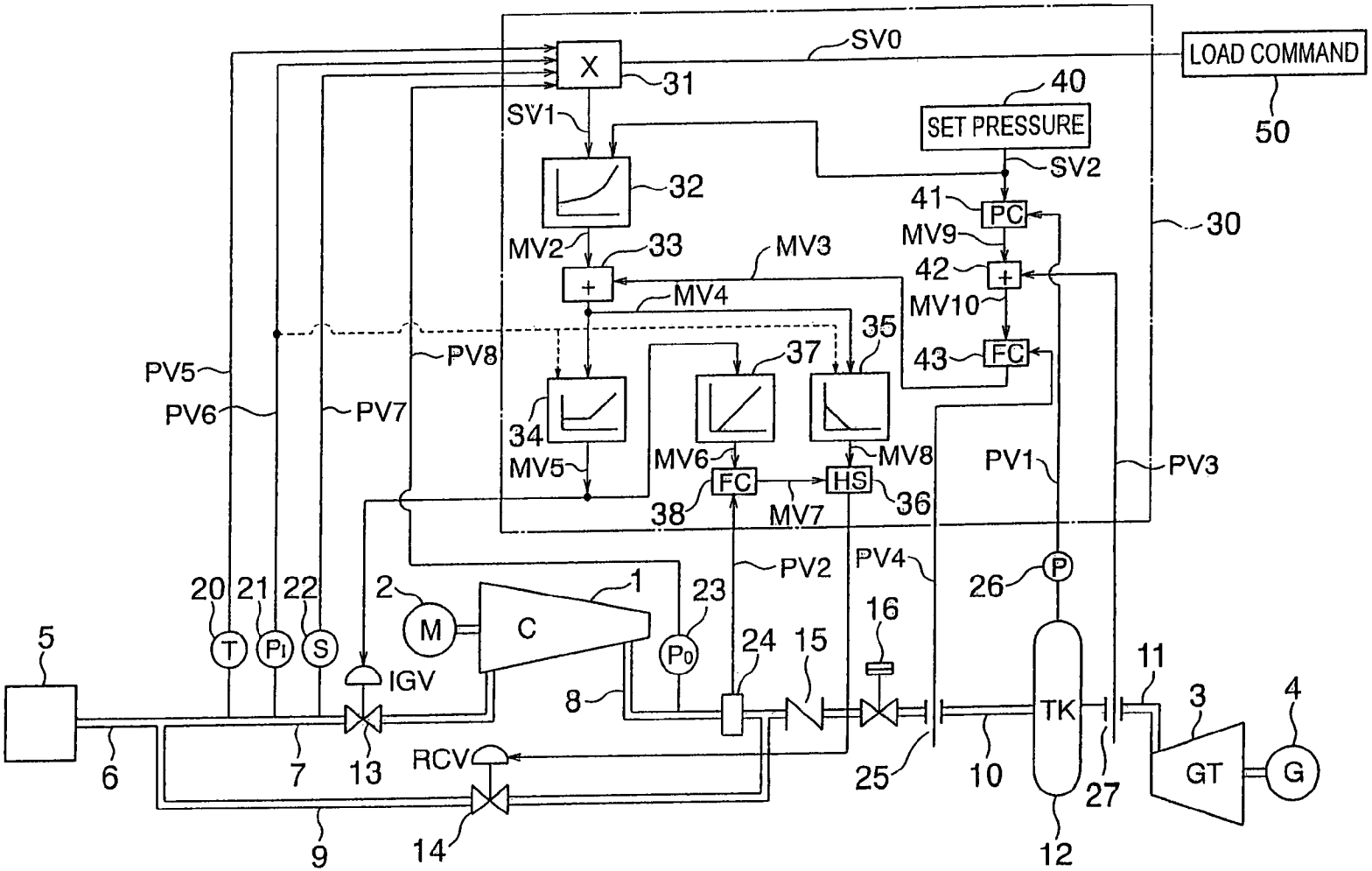
FIG. 1 is a block diagram of a fuel gas compression and supply line and a compressor control unit of a first embodiment according to the present invention.
Figure 2A:
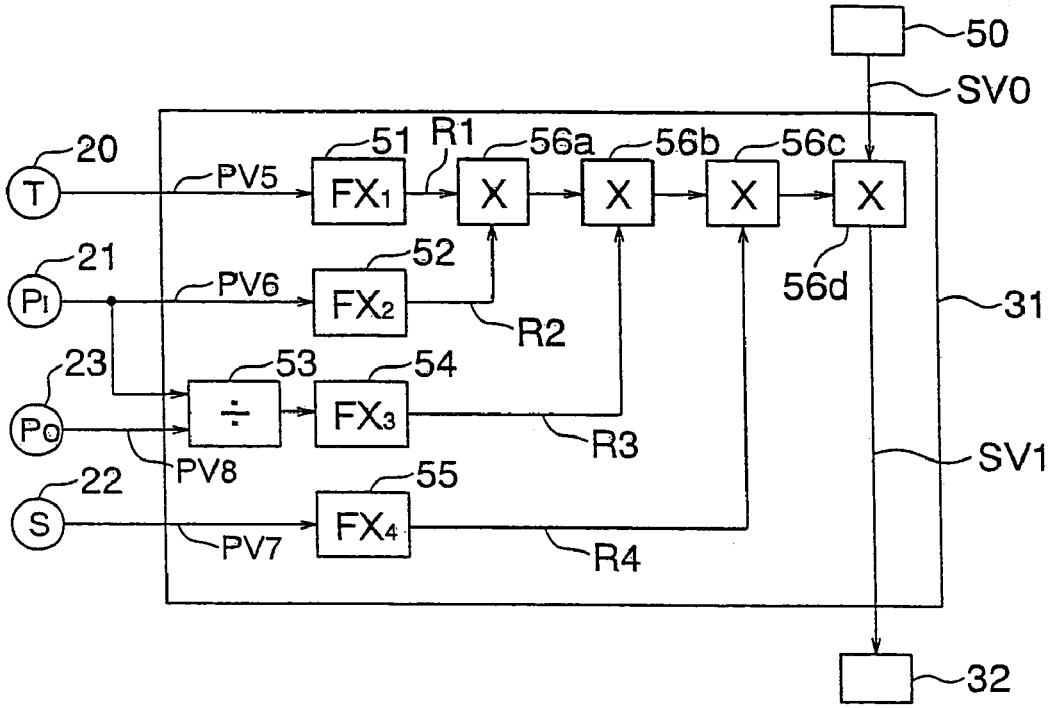
FIG. 2A is a control block diagram showing a first example of the gas condition corrector and FIG. 2B is a control block diagram showing a second example of the same.
Figure 2B:
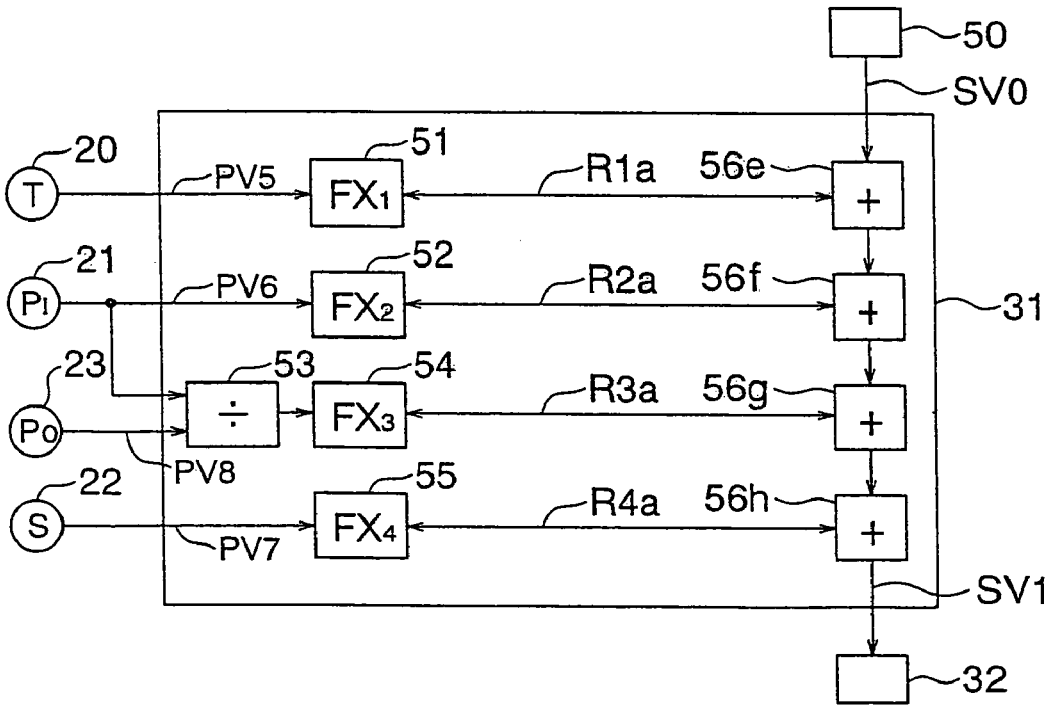
Figure 3:
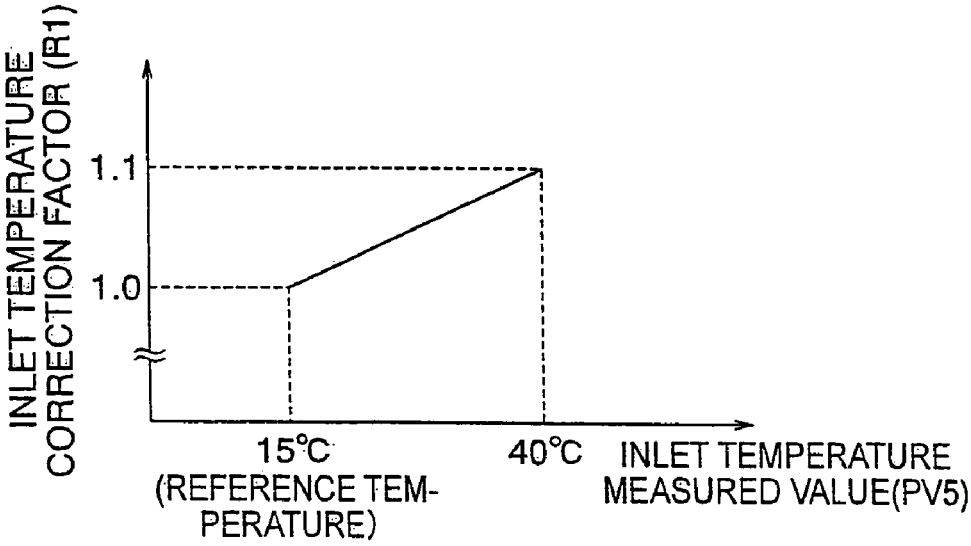
FIG. 3 is a graph exemplifying a relation between an inlet temperature measured value and an inlet temperature correction factor in a temperature function generator of FIG. 1.
Figure 4:
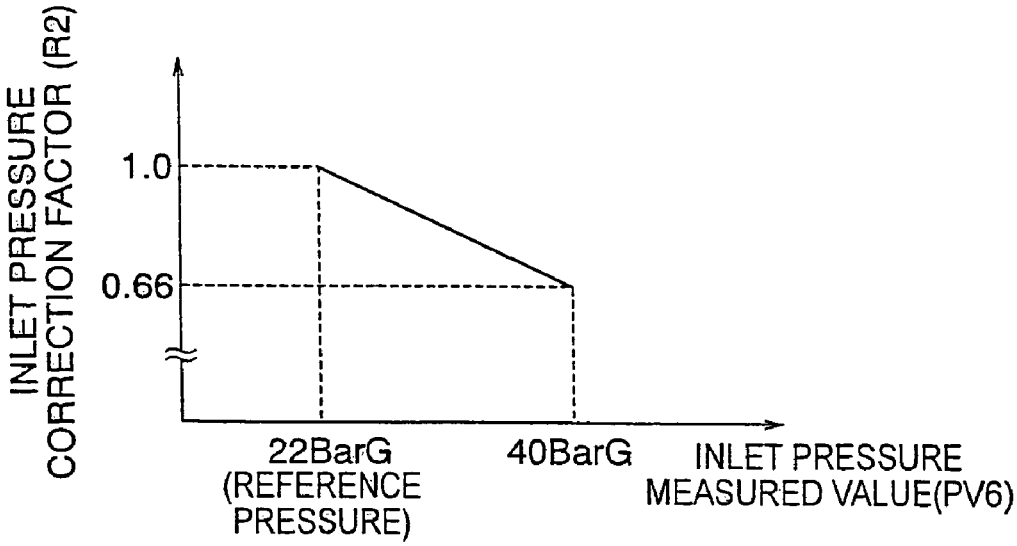
FIG. 4 is a graph exemplifying a relation between an inlet pressure measured value and an inlet pressure correction factor in a pressure function generator of FIG. 2.
Figure 5:
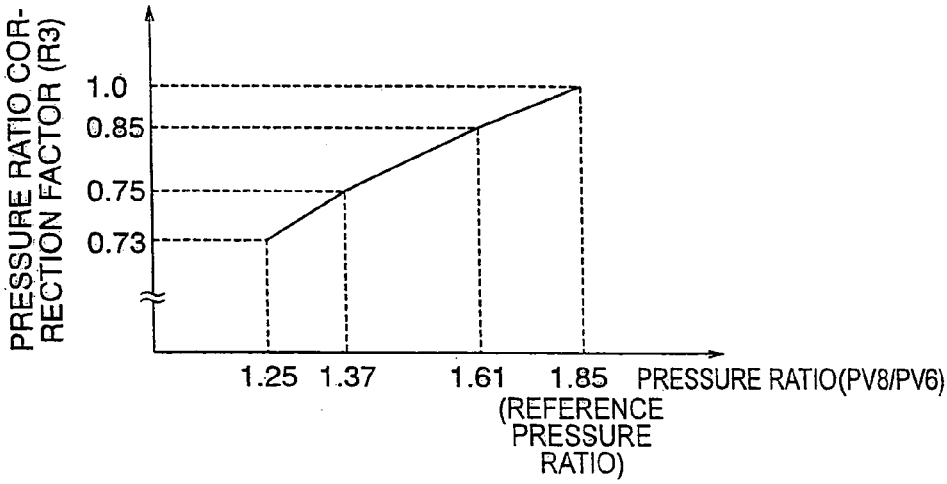
FIG. 5 is a graph exemplifying a relation between a pressure ratio and a pressure ratio correction factor in a pressure ratio function generator of FIG. 2.
Figure 6:
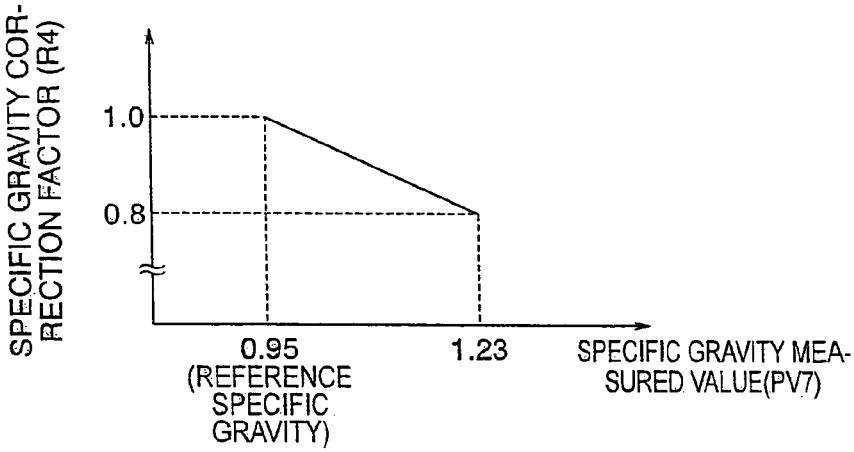
FIG. 6 is a graph exemplifying a relation between a specific gravity measured value and a specific gravity correction factor in a gas specific gravity function generator of FIG. 2.

A first embodiment about the present invention is shown in FIGS. 1 to 13. FIG. 1 is a block diagram of a fuel gas compression and supply line and a compressor control unit of the first embodiment. FIG. 2 is a detailed block diagram of a gas condition corrector of FIG. 1, wherein FIG. 2A is a control block diagram showing a first example of the gas condition corrector and FIG. 2B is a control block diagram showing a second example of the same. FIG. 3 is a graph exemplifying a relation between an inlet temperature measured value and an inlet temperature correction factor in a temperature function generator of FIG. 2. FIG. 4 is a graph exemplifying a relation between an inlet pressure measured value and an inlet pressure correction factor in a pressure function generator of FIG. 2. FIG. 5 is a graph exemplifying a relation between a pressure ratio and a pressure ratio correction factor in a pressure ratio function generator of FIG. 2. FIG. 6 is a graph exemplifying a relation between a specific gravity measured value and a specific gravity correction factor in a gas specific gravity function generator of FIG. 2.

Figure 7:
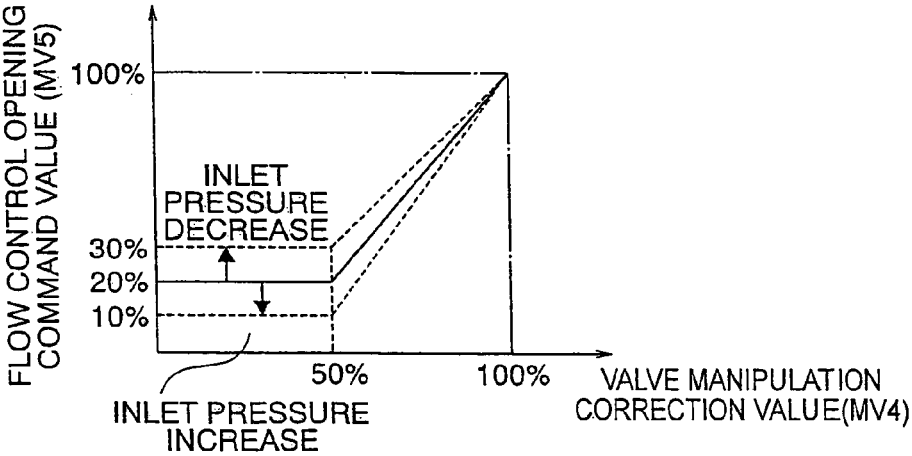
FIG. 7 is a graph exemplifying a relation between a valve manipulation correction factor and a flow control command value when the flow control command value is changed by the inlet pressure measured value in a flow control function generator of FIG. 1.

FIG. 7 is a graph exemplifying a relation between a valve manipulation correction factor and a flow control command value when the flow control command value is changed by the inlet pressure measured value in a flow control function generator of FIG. 1.

Figure 8:
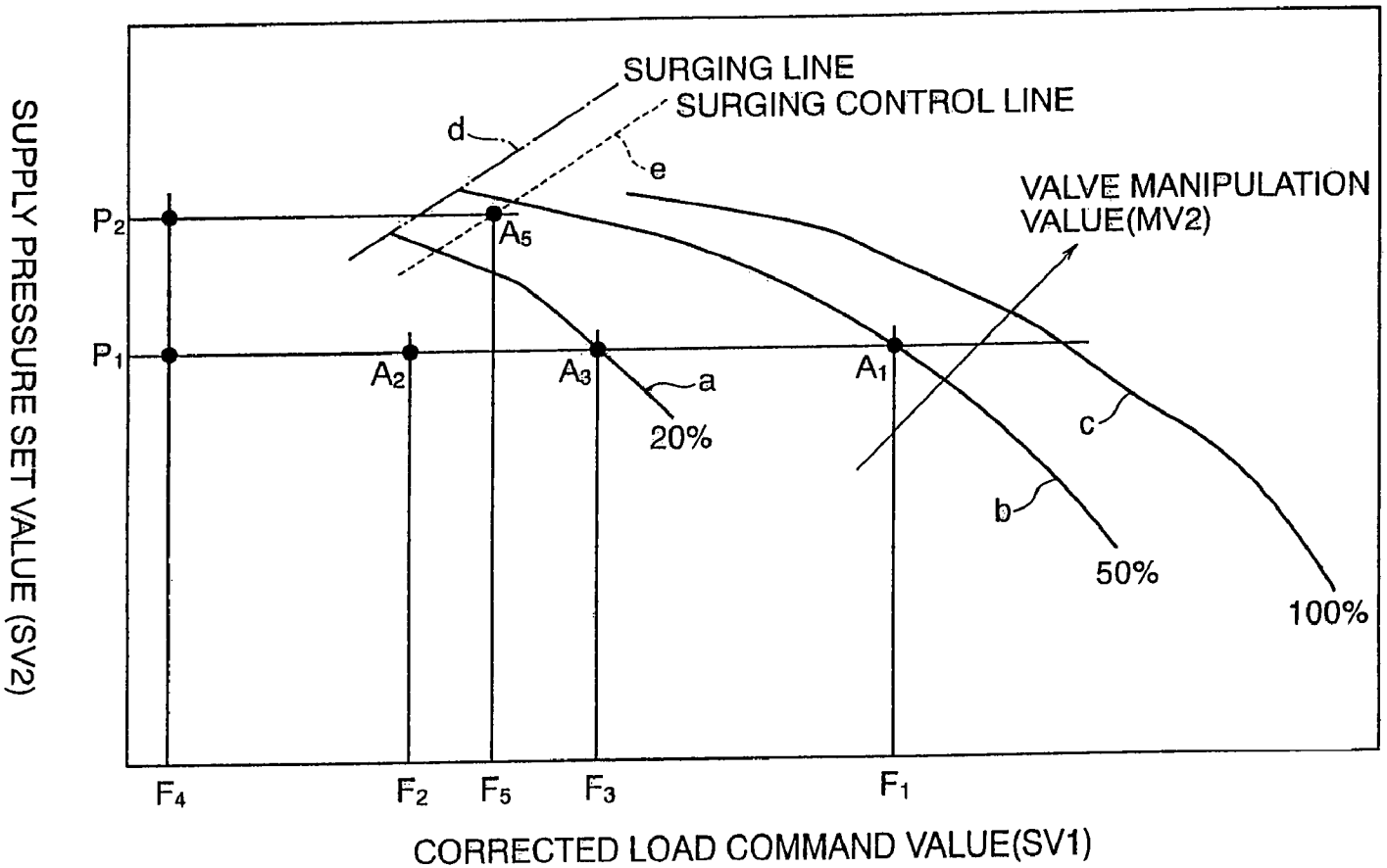
FIG. 8 is a characteristic diagram exemplifying a relation between a corrected load command value and a supply pressure set value, with a valve manipulation value being a parameter, in a command value function generator of FIG. 1.
Figure 9:
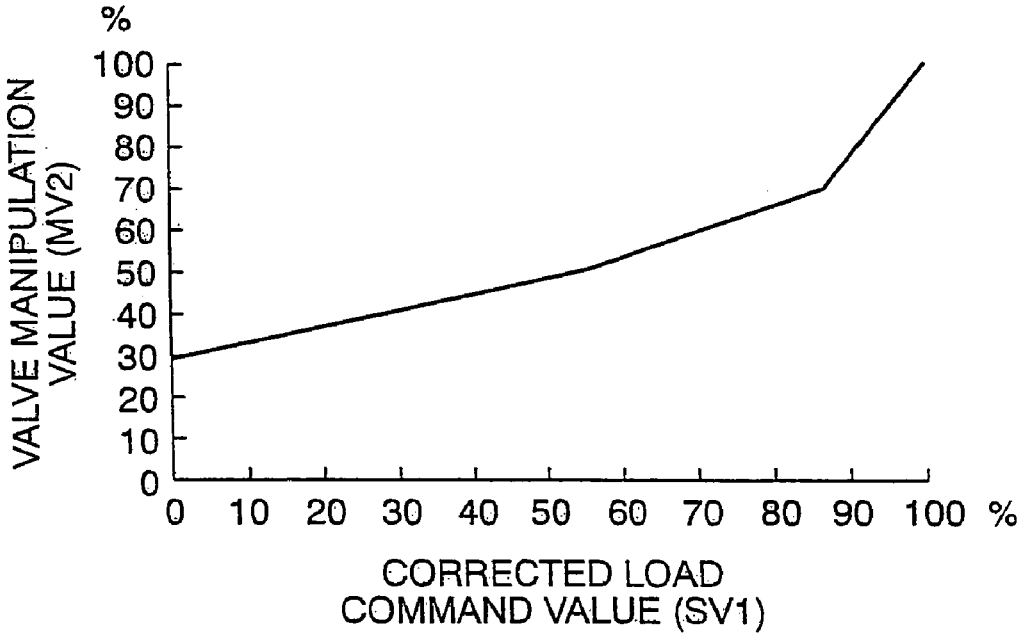
FIG. 9 is a graph exemplifying a relation between the corrected load command value and the valve manipulation value in the command value function generator of FIG. 1.

FIG. 8 is a characteristic diagram exemplifying a relation between a corrected load command value and a supply pressure set value, with a valve manipulation value being a parameter, in a command value function generator of FIG. 1. FIG. 9 is a graph exemplifying a relation between the corrected load command value and the valve manipulation value in the command value function generator of FIG. 1.

Figure 10:
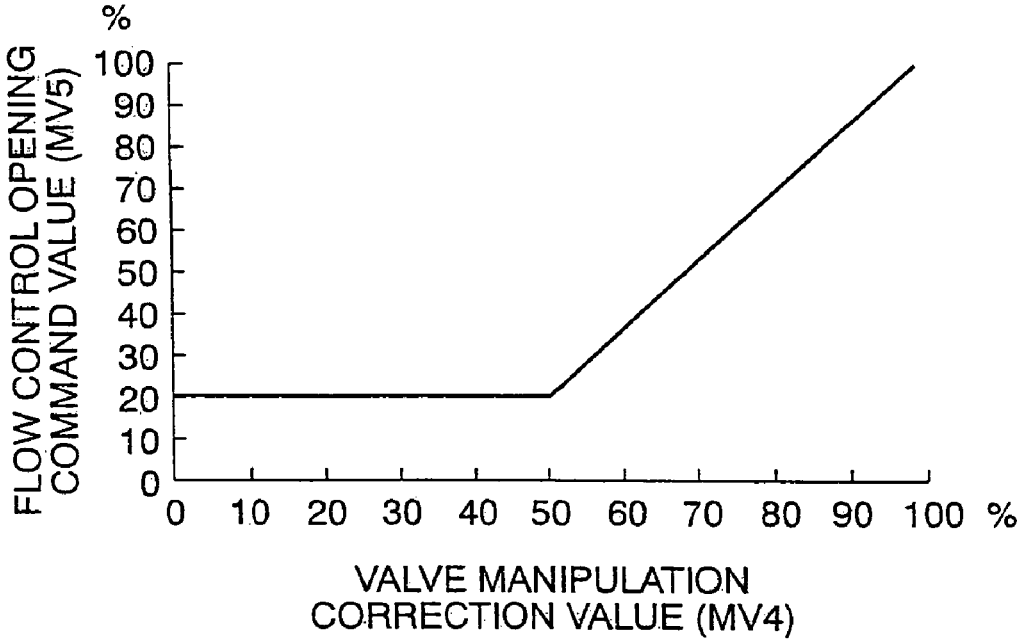
FIG. 10 is a graph exemplifying a function of the valve manipulation correction value and the flow control command value in the flow control function generator of FIG. 1.
Figure 11:
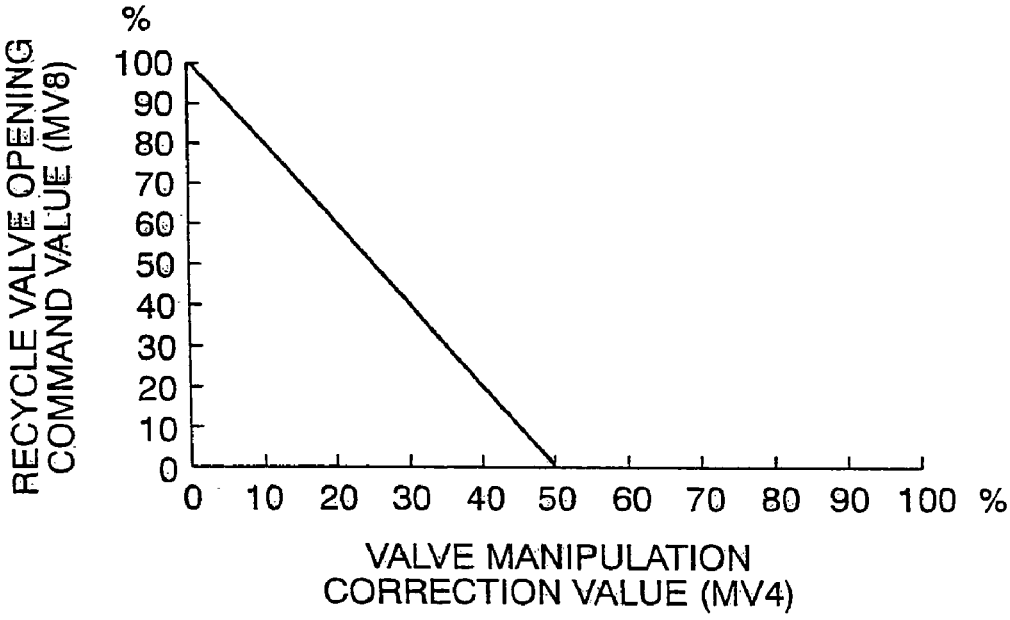
FIG. 11 is a graph exemplifying a function of the valve manipulation correction value and a recycle valve opening command value in a recycle valve function generator of FIG. 1.
Figure 12:
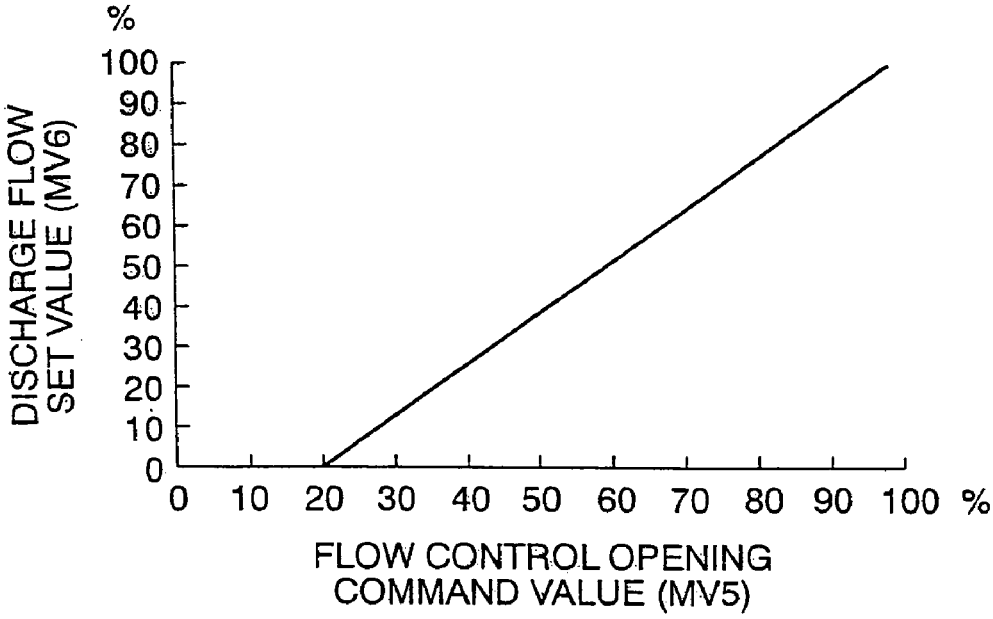
FIG. 12 is a graph exemplifying a function of the flow control opening command value and a discharge flow set value in a discharge flow control set value function generator of FIG. 1.

FIG. 10 is a graph exemplifying a function of the valve manipulation correction value and the flow control command value in the flow control function generator of FIG. 1. FIG. 11 is a graph exemplifying a function of the valve manipulation correction value and a recycle valve opening command value in a recycle valve function generator of FIG. 1. FIG. 12 is a graph exemplifying a function of the flow control opening command value and a discharge flow set value in a discharge flow control set value function generator of FIG. 1.

Figure 13A:
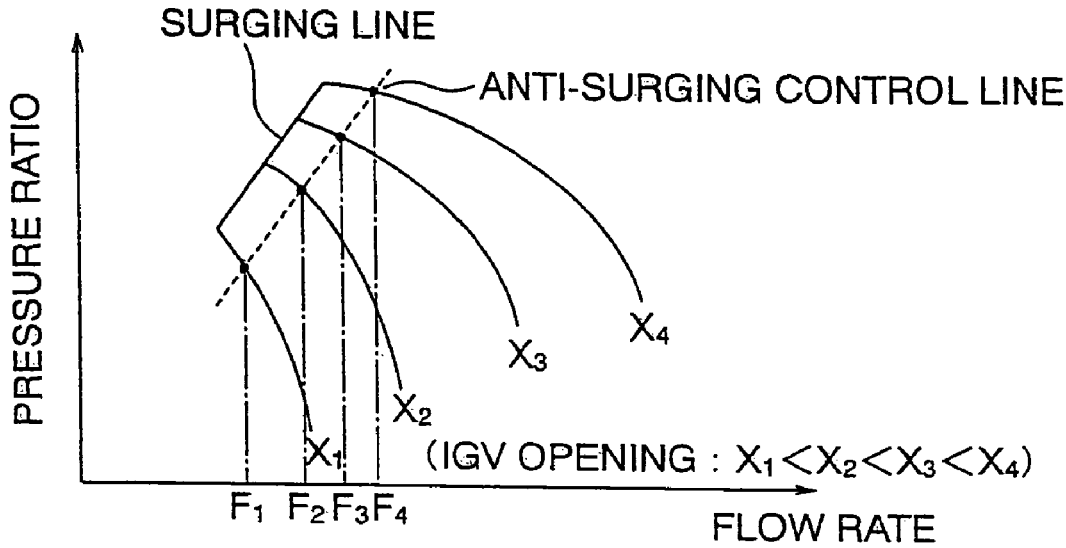
FIG. 13 is a diagram exemplifying a relation between an IGV opening and a flow set value in an anti-surging control line of the discharge flow control set value function generator of FIG. 1.
Figure 13A:
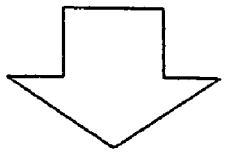
Figure 13B:
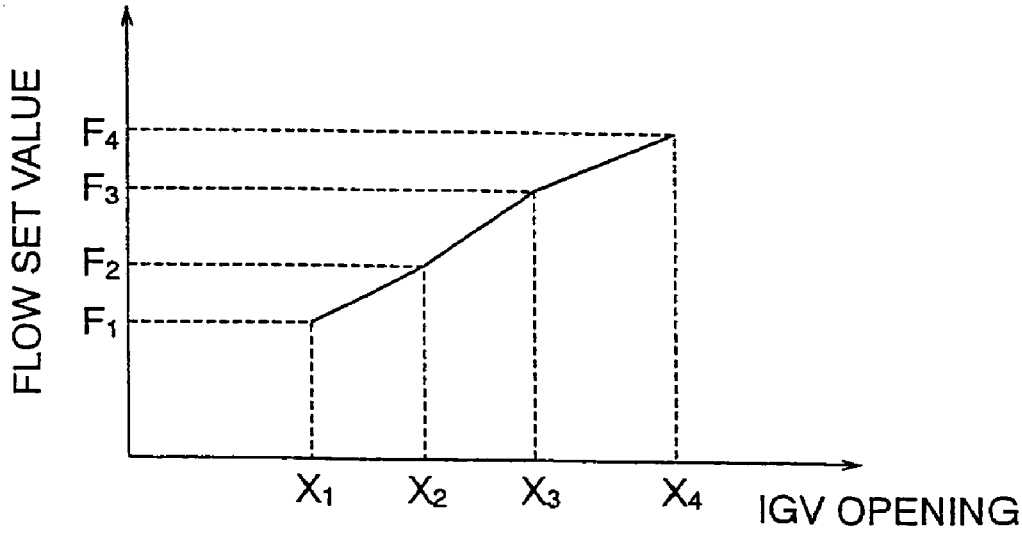

FIG. 13 is a diagram exemplifying a relation between an IGV opening and a flow set value in an anti-surging control line of the discharge flow control set value function generator of FIG. 1.

In FIG. 1, a fuel gas supply source 5 is connected to a suction side of a compressor 1 via a fuel gas supply line (piping) 6, an inlet guide vane (herein referred to as "IGV") 13 as an inlet flow rate control of the fuel gas and a compressor suction line (piping) 7.

Here, the condition of the fuel gas to be supplied from the fuel gas supply source 5 (gas temperature, inlet pressure, specific gravity, etc.) variously changes according to the kind of the fuel gas supply source 5 (gas well or gas tank), operating condition of other gas-using plants connected in parallel to the fuel gas supply source 5, temperature changes due to the season, day or night, etc.

Also, a rotor of the compressor 1 is connected to a motor (prime mover) 2, such as a steam turbine, electric motor or the like, via a gear coupling, etc. (not shown).

A discharge side of the compressor 1 is connected to an inlet of a header tank 12 via a compressor discharge line (piping) 8, a check valve 15, a shut-off valve 16 and a header tank supply line (piping) 10. An outlet of the header tank 12 is connected to a gas turbine 3 via a gas turbine supply line (piping) 11.

A rotor of the gas turbine 3 is connected to a generator 4 via a gear, coupling, etc. (not shown).

Also, at a gas inlet of the gas turbine 3, a governor as a flow control valve (not shown) is provided for adjusting an inlet flow rate of the fuel gas according to the load required (demanded power of the generator).

The compressor discharge line 8 and the fuel gas supply line are connected to a recycle line (or return piping or bypass piping) 9 in which a recycle valve (RCV) (or return valve) 14 is located.

The temperature of the fuel gas flowing in the recycle line 9 becomes high as the result of being compressed by the compressor 1. Although a gas cooler (not shown) is installed in the recycle line 9, in case of a sudden charge of the fuel gas flow rate or the like, it is not sufficient to cool down the gas temperature at the time and this also becomes one reason for rising of the fuel gas temperature in the compressor suction line 7.

The recycle valve 14 has also an anti-surging control function. If the compressor 1 becomes a surging phenomenon, in order to rapidly prevent that condition, the recycle valve 14 functions to open so that the discharge pressure drops. For this purpose, the recycle valve 14 has an excellent response ability and control accuracy as compared with the IGV13.

In the above-mentioned construction, the fuel gas supplied from the fuel gas supply source 5 flows through the fuel gas supply line 6, IGV13 and compressor suction line 7 and flows into the compressor 1 to be compressed there.

The fuel gas compressed by the compressor 1 flows through the compressor discharge line 8, check valve 15, shut-off valve 16 and header tank supply line 10 and flows in to the header tank 12. The header tank 12 has a function to buffer sudden changes of pressure, flow rate or the like of the fuel gas. The fuel gas in the header tank 12 flows through the gas turbine supply line 11 to be supplied into the gas turbine 3 for combustion therein so that the generator 4 is driven.

The compressor suction line 7 is provided with an inlet gas temperature indicator 20 that measures temperature of the fuel gas to be supplied into the compressor 1 and puts out an inlet temperature measured value PV5, an inlet gas pressure indicator 21 that measures pressure of the fuel gas and puts out an inlet pressure measured value PV6 and a gas specific gravity meter 22 that measures specific gravity of the fuel gas and puts out a specific gravity measured value PV7.

The compressor discharge line 8 is provided with an outlet gas pressure indicator 23 that measures pressure of the fuel gas discharged from the compressor 1 and puts out an outlet pressure measured value PV8 and an outlet gas flow meter 24 that measures flow rate of the fuel gas and puts out a discharge flow measured value PV2.

The header tank supply line 10 is provided with a header tank supply line flow meter 25 that measures supply flow rate of the fuel gas to be supplied into the header tank 12 and puts out a tank supply flow rate measured value PV4.

The header tank 12, or the header tank supply line 10 near the header tank 12, is provided with a header tank pressure indicator 26 that detects pressure of the fuel gas in the header tank 12 and puts out a turbine supply pressure measured value PV1.

The gas turbine supply line 11 is provided with a gas turbine supply line flow meter 27 that measures flow rate of the fuel gas to be supplied into the gas turbine 3 and puts out a gas turbine supply flow rate measured value PV3.

Reference numeral 30 designates a compressor control unit of the compressor 1. While the gas turbine 3 is operated, the measured values of the above-mentioned inlet gas temperature indicator 20, inlet gas pressure indicator 21, gas specific gravity meter 22, outlet gas pressure indicator 23, outlet gas flow meter 24, header tank supply line flow meter 25, header tank pressure indicator 26 and gas turbine supply line flow meter 27 are put out into the compressor control unit 30 via respective signal wirings.

Also, a gas condition corrector 31 of the compressor control unit 30 is inputted with a load command value SV0, that is a demand fuel gas flow rate for the gas turbine 3, from a gas turbine controller 50 or a central control room.

Generally, the respective measured values or output signals given by the above-mentioned measuring devices or operating panels are converted into predetermined electric signals.

Also, while the compressor control unit 30 is integrally or separately provided with the gas turbine controller 50 and each of function generators, calculating units or the like of the compressor control unit 30 is operated by using a program, sequence block or memory, the compressor control unit 30 and various devices therein are not limited to those mentioned here but may be constructed by individual electric circuits as well.

Next, the calculation process at the gas condition corrector 31 of the compressor control unit 30 will be described with reference to FIG. 2.

In operation, even if the load command value SV0 is the same, the fuel gas supply flow rate to the gas turbine 3 widely changes according to the fuel gas condition (gas temperature, inlet pressure, specific gravity, outlet pressure, etc.).

Thus, the inputted load command value SV0 is corrected, as follows, by the gas condition corrector 31 of the compressor control unit 30 so that, even if the compression condition changes, combustion in the gas turbine is not changed.

That is, according to the fuel gas condition (temperature, inlet pressure, specific gravity, outlet pressure, etc.), the gas condition corrector 31 carries out a correction to increase or decrease the load command value SV0.

In the gas condition corrector 31, as shown in FIG. 2A, a temperature function generator 51 is inputted with the inlet temperature measured value PV5 of the fuel gas from the inlet gas temperature indicator 20 located in the compressor suction line 7.

Then, by a function shown in FIG. 3, the temperature function generator 51 calculates an inlet temperature correction factor R1, that becomes higher as the inlet temperature measured value PV5 becomes higher, to be put out into a multiplier 56*a*.

The conversion function in the temperature function generator 51 is such a conversion function that, as shown in FIG. 3, the inlet temperature correction factor R1 increases substantially in proportion to the absolute temperature from a reference point at which the inlet temperature correction factor R1 is 1.0 when the inlet temperature measured value PV5 is a previously set (reference) temperature (for example, 15° C. or 288° K).

Also, a pressure function generator 52 is inputted with the inlet pressure measured value PV6 of the fuel gas from the inlet gas pressure indicator 21 located in the compressor suction line 7.

Then, the pressure function generator 52 compares the inlet pressure measured value PV6 with a previously set (reference) pressure (for example, 22 BarG) and calculates an inlet pressure correction factor R2, that becomes lower in proportion to the inlet pressure measured value RV6, as shown in FIG. 4, to be put out into the multiplier 56*a*.

The above-mentioned inlet pressure measured value PV6 is also inputted into a divider 53. The divider 53 is also inputted with the outlet pressure measured value PV8 of the fuel gas from the outlet gas pressure indicator 23 located in the compressor discharge line 8.

The divider 53 calculates a pressure ratio of the inlet pressure measured value PV6 and the outlet pressure measured value PV8 to be put out into a pressure ratio function generator 54.

Then, by a function shown in FIG. 5, the pressure ratio function generator 54 compares the above-mentioned pressure ratio with a previously set (reference) pressure ratio (for example, a pressure ratio of 1.85) and calculates a pressure ratio correction factor R3, that becomes lower as the calculated pressure ratio becomes lower, as shown in FIG. 5, to be put out into the multiplier 56*b*.

A gas specific gravity function generator 55 is inputted with the specific gravity measured value PV7 of the fuel gas from the gas specific gravity meter 22 located in the compressor suction line 7.

Then, by a function shown in FIG. 6, the gas specific gravity function generator 55 compares the specific gravity measured value PV7 with a previously set (reference) specific gravity (for example, a specific gravity of 0.95) and calculates a specific gravity correction factor R4, that becomes lower in proportion to the specific gravity measured value PV7, to be put out into a multiplier 56*c*.

At the multiplier 56*a*, the inlet temperature correction factor R1 inputted from the temperature function generator 51 is multiplied by the inlet pressure correction factor R2 inputted from the pressure function generator 52 and this multiplication result is put out into the multiplier 56*b*.

At the multiplier 56*b*, the multiplication result inputted from the multiplier 56*a* is multiplied by the pressure ratio correction factor R3 inputted from the pressure ratio function generator 54 and this multiplication result is put out into the multiplier 56*c*.

At the multiplier 56*c*, the multiplication result inputted from the multiplier 56*b* is multiplied by the specific gravity correction factor R4 inputted from the gas specific gravity function generator 55 and this multiplication result is put out into a multiplier 56*d*.

At the multiplier 56*d*, the load command value SV0 inputted from the gas turbine controller 50 is multiplied by the multiplication result inputted from the multiplier 56*c*. That is, at the gas condition corrector 31, the load command value SV0 inputted from the gas turbine controller 50 is corrected by being multiplied by the inlet temperature correction factor R1, inlet pressure correction factor R2, pressure ratio correction factor R3 and specific gravity correction factor R4, so that a corrected load command value SV1 is calculated. This corrected load command value SV1 is put out into a command value function generator 32.

However, the correction calculating mode to obtain the corrected load command value SV1 from the load command value SV0 is not limited to the one mentioned above. Also, the order of calculation is not limited to the one mentioned above but a calculating mode as shown in FIG. 2B, for example, may be employed.

That is, at the function generators 51, 52, 54 and 55, the respective factors calculated as mentioned above are subtracted by 1 each so that an inlet temperature correction load factor R1*a*, an inlet pressure correction load factor R2*a*, a pressure ratio correction load factor R3*a* and a specific gravity correction load factor R4*a* are calculated. Then, these correction load factors are added to the load command value SV0 at respective adders 56*e*, 56*f*, 56*g* and 56*h* and finally a corrected load command value SV1, like the one as shown in FIG. 2A, is calculated to be put out into the command value function generator 32.

With respect to the correction to the corrected load command value SV1 from the load command value SV0, it is preferable to make the correction based on all of the above-mentioned inlet temperature measured value PV5, inlet pressure measured value PV6, specific gravity measured value PV7, pressure ratio of the inlet pressure measured value PV6 and the outlet pressure measured value PV8, and outlet pressure measured value PV8. However, if not based on all of them, the correction of the load command value SV0 may actually be made by the combination of one or more of the following calculations, taking account of the influential degree of each of the compression conditions given on the changes of the combustion in the gas turbine 3;

a) Based on the inlet temperature measured value PV5 only, the temperature function generator 51 calculates the inlet temperature correction factor R1 or inlet temperature correction load factor R1*a* so that the corrected load command value SV1 is calculated.

b) Based on the specific gravity measured value PV8 only, the gas specific gravity function generator 55 calculates the specific gravity correction factor R4 or specific gravity correction load factor R4*a* so that the corrected load command value SV1 is calculated.

c) Based on the pressure ratio of the inlet pressure measured value PV6 and the outlet pressure measured value PV8, the pressure ratio function generator 54 calculates the pressure ratio correction factor R3 or pressure ratio correction load factor R3*a* and based on the inlet pressure measured value PV6, the pressure function generator 52 calculates the inlet pressure correction factor R2 or inlet pressure correction load factor R2*a*, so that the corrected load command value SV1 is calculated.

d) Based on the inlet temperature measured value PV5, the temperature function generator 51 calculates the inlet temperature correction factor R1 or inlet temperature correction load factor R1*a* and based on the specific gravity measured value PV7, the gas specific gravity function generator 55 calculates the specific gravity correction factor R4 or specific gravity correction load factor R4*a*, so that the corrected load command value SV1 is calculated.

e) Based on the inlet temperature measured value PV5, the temperature function generator 51 calculates the inlet temperature correction factor R1 or inlet temperature correction load factor R1*a* and based on the pressure ratio of the inlet pressure measured value PV6 and the outlet pressure measured value PV8, the pressure ratio function generator 54 calculates the pressure ratio correction factor R3 or pressure ratio correction load factor R3*a* and also based on the inlet pressure measured value PV6, the pressure function generator 52 calculates the inlet pressure correction factor R2 or inlet pressure correction load factor R2*a*, so that the corrected load command value SV1 is calculated.

f) Based on the specific gravity measured value PV8, the gas specific gravity function generator 55 calculates the specific gravity correction factor R4 or specific gravity load factor R4*a* and based on the pressure ratio of the inlet pressure measured value PV6 and the outlet pressure measured value PV8, the pressure ratio function generator 54 calculates the pressure ratio correction factor R3 or pressure ratio correction load factor R3*a* and also based on the inlet pressure measured value PV6, the pressure function generator 52 calculates the inlet pressure correction factor R2 or inlet pressure correction load factor R2*a*, so that the corrected load command value SV1 is calculated.

Thus, out of the gas condition of the fuel gas (temperature, inlet pressure, specific gravity, outlet pressure, etc.), one or more factors having a higher degree of influence given on the changes of the gas turbine 3 combustion are selected so that the correction is carried out. Thereby, the changes of the combustion can be efficiently reduced.

Next, the calculation process at the command value function generator 32 of the compressor control unit 30 will be described with reference to FIGS. 8 and 9.

At the command value function generator 32, based on the corrected load command value SV1 inputted from the compression condition corrector 31 and based on a supply pressure set value SV2 inputted from a pressure setter 40 of the compressor control unit 30, a valve manipulation value MV2 is calculated by a function shown in FIG. 8.

That is, in FIG. 8, pressure/flow characteristic curves a, b and c exemplify relations between a discharge flow and a discharge pressure of the compressor 1 in the case where the opening of the IGV13 is 20%, 50% and 100%, respectively.

According to these relations, under a predetermined condition of the temperature, pressure, specific gravity, etc. of the fuel gas, that is, for example, as shown in FIG. 1, in case where the supply pressure set value SV2 set by the pressure setter 40 is P1 and the corrected load command value SV1 inputted from the gas condition corrector 31 is $F_1$, if the valve operation value MV2 of the IGV13 is set to 50%, the compressor 1 is operated at an operation point $A_1$.

Then, if the corrected load command value SV1 inputted from the gas condition corrector 31 lowers, the opening of the IGV13 is reduced so that the discharge flow of the fuel gas is reduced until it matches with the corrected load command value SV1.

However, because of the structure of the IGV13, a controllability of the IGV operation becomes worse in an opening range less than a certain opening. For this reason, in the first embodiment according to the present invention, a minimum opening of the IGV13 by which an accurate flow control is possible by the IGV13 is set, as described later, so that the opening of the IGV13 in no case becomes less than this minimum opening (in the present example, the minimum opening is set to 20%).

If such a minimum opening is set, however, once the IGV13 has reached this minimum opening, to make the discharge flow smaller thereafter becomes difficult. Hence, as will be described later, if the IGV13 has reached the minimum opening, this opening is held as it is and, at the same time, the operation is done such that a portion of the fuel gas discharged from the compressor 1 is returned to the fuel gas supply line 6 side via the recycle valve 14.

That is, supposing that a demanded discharge flow of the fuel gas is $F_2$, as shown in FIG. 8, for example, if the control is done only by the IGV13, it will be only possible to reduce the discharge flow to F3 that is a discharge flow corresponding to the opening of 20% ($F_3>F_2$). Hence, the recycle valve 14 is opened so that the fuel gas of the quantity corresponding to ($F_3-F_2$) is returned or recycled to the fuel gas supply line 6 side. Thereby, the fuel gas of the above-mentioned demanded flow of $F_2$ can be supplied to the gas turbine 3 side.

In this case, the operation point of the compressor 1 is not $A_2$ but $A_3$ ($A_3>A_2$).

The above-mentioned relation between the corrected load command value SV1 and the valve manipulation value MV2 according to FIG. 8 becomes a function as shown in FIG. 9.

Thus, the valve manipulation value MV2 calculated at the command value function generator 32 is put out into an opening command adder 33.

At the opening command adder 33, the valve manipulation value MV2 inputted from the command value function generator 32 and a correction manipulation value MV3 put out from a flow controller 43, to be described later, are added together so that a valve manipulation correction value MV4 is obtained. This valve manipulation correction value MV4 is put out into a flow control function generator 34 and a recycle valve function generator 35.

It is to be noted that while the compressor 1 is being steadily operated, the valve manipulation correction value MV4 obtained by the opening command adder 33 becomes approximately the same as the valve manipulation value MV2 to be used for a feedforward control. That is, during a steady operation, the turbine supply pressure measured value PV1 as the pressure in the header tank 12 is maintained to the supply pressure set value SV2 set by the pressure setter 40 and both of the flow rate of the fuel gas flowing into the header tank 12 and the flow rate of the fuel gas flowing out thereof are constant, that is, the gas turbine supply flow rate measured value PV3 is equal to the tank supply flow rate measured value PV4. Hence, the correction operation value MV3 becomes substantially zero.

Next, the correction operation value MV3 for the feedforward control to be inputted into the opening command adder 33 will be described.

In the compressor control unit 30 of the compressor 1, the pressure setter 40 is provided for setting the supply pressure set value SV2 of the fuel gas to be supplied into the gas turbine 3. This supply pressure set value SV2 is inputted into a pressure controller 41.

On the other hand, the turbine supply pressure measured value PV1 detected by the header tank pressure indicator 26 is also inputted into the pressure controller 41.

At the pressure controller 41, based on a deviation between the supply pressure set value SV2 and the turbine supply pressure measured value PV1, a PI (proportional and integral) calculation process is carried out so that a pressure manipulation value MV9 is calculated by the following equation to be put out into an adder 42 as a manipulation signal to be used for a feedback control:

$$MV9 \text{ (The pressure manipulation value)} = K_1 \cdot (SV2 - PV1) + K_2 \int (SV2 - PV1)dt$$

At the adder 42, this pressure manipulation value MV9 and the gas turbine supply flow rate measured value PV3 (for the feedforward control) inputted from the gas turbine supply line flow meter 27 are added together by the following equation so that a pressure manipulation correction value MV10 is obtained to be put out into the flow controller 43.

$$MV10 \text{ (The pressure manipulation correction value)} = MV9 + K_3 \cdot PV3$$

The flow controller 43 is also inputted with the tank supply flow rate measured value PV4 (for the feedforward control) from the header tank supply line flow meter 25.

At the flow controller 43, based on a deviation between the pressure manipulation correction value MV10 and the tank supply flow rate measured value PV4, a PI calculation process is carried out so that a manipulation increase or decrease value (for a feedforward signal) is calculated. That is, finally, at the pressure controller 41, adder 42 and flow controller 43, the correction manipulation value MV3 is calculated by the following equation:

$$MV39 \text{ (The correction manipulation value)} = K_4 \cdot (MV10 - PV4) + K_5 \int (MV10 - PV4)dt$$

In the above, $K_1$ to $K_5$ are constants, respectively.

Thus, by a combination of the feedforward control and the feedback control, a pressure control gets a high response ability.

At the flow control function generator 34 inputted with the valve manipulation correction value MV4 from the opening command adder 33, as mentioned above, based on a function exemplified in FIG. 10, a flow control opening command value MV5 is calculated such that the above-mentioned minimum opening (20%, for example) is maintained until the valve manipulation correction value MV4 increases to 50% from 0%, for example, and then as the valve manipulation correction value MV4 further increases from 50%, the flow control opening command value MV5 linearly increases up to 100% from 20%.

It is to be noted that, in place of the calculation by the pressure function generator 52 as shown in FIG. 2, the inlet pressure measured value PV6 of the fuel gas is inputted from the inlet gas pressure gauge 21, as shown by broken lines in FIG. 1, and corresponding to this inlet pressure measured value PV6, the minimum opening of the IGV13 may be changed. That is, the control is done such that, as shown in FIG. 7, if the inlet pressure measured value PV6 becomes lower than a previously set (reference) pressure, the minimum opening is increased (30%, for example) and if the inlet pressure measured value PV6 becomes higher than that, the minimum opening is decreased (10%, for example) and then as the valve manipulation correction value MV4 increases from 50%, the flow control opening command value MV5 linearly increases up to 100% from the minimum opening so increased or decreased.

Also, in FIG. 10, while a split point of the IGV13 and recycle valve 14 is set to 50%, this split point is not always 50%. That is, the inclination of the function shown in FIG. 10 regulates respective control gains of the IGV13 and in order to change the control gains, the split point may be changed corresponding to the inlet pressure measured value PV6.

For example, if the split point is made larger than 50% corresponding to the inlet pressure measured value PV6, an acting time of the IGV13 that is short of the response ability can be shortened and also an action stability of the recycle valve 14 that is excellent in the response ability can be enhanced.

Thus, taking account of the dynamic characteristic, etc. of the IGV13, the split point can be appropriately set so that a controllability thereof is enhanced.

On the other hand, the IGV13 comprises a drive mechanism, such as an air actuator, etc., for operating the vane as well as comprises a vane opening transmitter and an IGV operating unit (all not shown).

At the IGV operating unit, based on an opening command from outside, a position feedback control is carried out so that an opening command value coincides with an opening measured value from the valve opening transmitter. Then, the flow control opening command value MV5 from the flow control function generator 34 is inputted into the IGV operating unit so that the opening of the IGV13 is controlled by the IGV operating unit.

Likewise, at the recycle valve function generator 35 inputted with the valve manipulation correction value MV4 from the opening command adder 33, based on a function exemplified in FIG. 11, a recycle valve opening command value MV8 is calculated such that the opening of the recycle valve 14 linearly decreases until the valve manipulation correction value MV4 increases to 50% from 0%, for example, and then when the valve manipulation correction value MV4 is 50% or more, the opening of the recycle valve 14 is maintained to 0%. The recycle valve opening command value MV8 so calculated is put out into a higher order selector 36.

It is to be noted that, in the present first embodiment, while the split point of the recycle valve 14 is set to 50%, as shown in FIG. 11, the split point is not limited to 50%. That is, the inlet pressure measured value PV6 of the fuel gas is inputted from the inlet gas pressure indicator 21 and corresponding to this inlet pressure measured value PV6, the split point of the recycle valve 14 may be changed.

As the inclination of the function shown in FIG. 11 regulates respective control gains of the recycle valve 14, in order to change the control gains, in place of the calculation by the pressure function generator 52 shown in FIG. 2, the split point may be changed corresponding to the inlet pressure measured value PV6, as shown by the broken lines in FIG. 1.

For example, if the split point is made larger than 50%, an action stability of the recycle valve 14 that is excellent in the response ability can be enhanced.

Thus, taking account of the dynamic characteristic, etc. of the recycle valve 14, the split point can be appropriately set so that a controllability thereof is enhanced.

Next, a discharge flow control set value function generator 37 will be described.

In FIG. 8, a surging line d for the compressor 1 and a surging control line e that is set so that a margin for an anti-surging is ensured are shown. The surging line d and surging control line e are both functions of the opening of the IGV13.

At the discharge flow control set value function generator 37, based on a function, as exemplified in FIG. 12, that shows the surging control line e of FIG. 8 as well as based on the flow control opening command value MV5 of the IGV13 given from the flow control function generator 34, a discharge flow set value MV6 for the anti-surging is calculated to be put out into a flow controller 38.

While the flow control opening command value MV5 or the opening signal from the above-mentioned valve opening transmitter is between 20% and 100%, as shown in FIG. 12, the conversion function at the discharge flow control set value function generator 37 is a function, as shown in FIG. 13(*a*), that is based on an anti-surging control line in which the discharge flow set value MV6 has a margin of about 10% from a surging line of performance curves of the compressor 1 for respective openings of the IGV.

At the flow controller 38, a discharge flow manipulation value MV7 corresponding to a deviation between the discharge flow set value MV6 and the discharge flow measured value PV2 detected by the outlet gas flow meter 24 is calculated to be put out into the higher order selector 36.

At the higher order selector 36, the recycle valve opening command value MV8 inputted from the recycle valve function generator 35 and the discharge flow manipulation value MV7 inputted from the flow controller 38 are compared with each other so that a larger one thereof is selected and a signal of the larger one is put out into the recycle valve 14 as a valve control signal.

Like the IGV13, the recycle valve 14 also comprises a drive mechanism, such as a hydraulic actuator, etc., for operating the valve as well as comprises a valve opening transmitter and a recycle valve operating unit (all not shown).

At the recycle valve operating unit, based on the signal inputted from the higher order selector 36, a position feedback control is carried out so as to coincide with the opening given from the valve opening transmitter.

By the construction mentioned above, the recycle valve 14 is selectively applied with the control of the higher order out of the discharge pressure control by the recycle valve opening command value MV8 and the anti-surging control by the discharge flow operation value MV7. Hence, a mutual interference between these controls also can be avoided.

Moreover, not only the IGV13 but also the recycle valve 14 are used for the discharge pressure control of the compressor 1. Thereby, an excellent control result can be obtained for all of the operation conditions (at the load shut-off time, at the usual operation time, etc.).

Further, as the IGV13 and the recycle valve 14 are operated in the split range, an interference of controls by these valves can be avoided.

Next, an operation of the compressor control unit 30 of the fuel gas compressor of the first embodiment according to the present invention will be described.

First, at the gas condition corrector 31, a correction is carried out so as to increase or decrease the load command value SV0 corresponding to the fuel gas condition (temperature, inlet pressure, specific gravity, outlet pressure, etc.). If all of the detected temperature, inlet pressure, specific gravity, outlet pressure, etc. are identical to the previously set (reference) values, the corrected load command value SV1 is equal to the load command value SV0.

Also, in case where the inlet temperature measured value PV5 is 20° C. while a reference temperature is 15° C., the inlet pressure measured value PV6 is 28 BarG while a reference pressure is 22 BarG, the specific gravity measured value PV7 is 1.09 while a reference specific gravity is 0.95 and the pressure ratio of the outlet pressure measured value PV8 and the inlet pressure measured value PV6 is 1.61 while a reference pressure ratio is 1.85, the inlet temperature correction factor R1 equals 1.02, the inlet pressure correction factor R2 equals 0.83, the pressure ratio correction factor R3 equals 0.85 and the specific gravity correction factor R4 equals 0.9.

Hence, the corrected load command value SV1 is calculated as follows:

$$SV1 \text{ (The correction load value )}=0.647\times \text{ the load command value } SV0 \text{ (50\%)}=32.38\%$$

This corrected load command value SV1 so calculated is put out into the command value function generator 32. Where the corrected load command value SV1 is $F_1$ and the supply pressure set value SV2 is $P_1$, as shown in FIG. 8, the valve manipulation value MV2 of 50% is calculated at the command value function generator 32.

In case where the correction manipulation value MV3 is 0%, the valve manipulation correction value MV4 becomes 50%. By the flow control opening command value MV5 put out from the flow control function generator 34 based on this valve operation correction value MV4, the opening of the IGV13 is set to 20%.

Also, by the recycle valve opening command value MV8 put out from the recycle valve function generator 35 based on the valve manipulation correction value MV4, the opening of the recycle valve 14 is set to 0%.

As the above-mentioned opening setting of the IGV13 and recycle valve 14 is carried out by the feedforward control, the discharge pressure of the compressor 1 is caused to rapidly approach a set value P1. Thus, finally, the above discharge pressure is accurately controlled to the set value $P_1$ by the feedback control based on the valve manipulation correction value MV4, so that the operation point of the compressor 1 becomes point $A_1$, as shown in FIG. 8.

Next, for example, in case where an output command demanding a discharge flow $F_2$ as shown in FIG. 8 is inputted into the compressor control unit 30 from the gas turbine controller 50, the opening of the IGV13 is set to 20% as the minimum opening. Thus, the flow of the fuel gas in the compressor 1 becomes $F_3$.

On the other hand, the opening of the recycle valve 14 is set so that the fuel gas of $(F_3-F_2)$ is recycled to the fuel gas supply line 6 side. That is, the recycle valve 14 is opened and a surplus fuel passing through the IGV13 is returned to the fuel gas supply line 6 side via the recycle valve 14. As the result thereof, the flow rate of the fuel gas flowing in the header tank supply line 10 becomes the discharge flow $F_2$ so demanded.

In this case also, the discharge pressure of the compressor 1 is caused to rapidly approach the target value $P_1$ by the opening setting of the IGV13 and recycle valve 14 carried out by the feedforward control and the above-mentioned discharge pressure is accurately controlled to the target value $P_1$ by the feedback control. As the result thereof, the operation point of the compressor 1 becomes point $A_3$.

Next, a case where a breaker of a power supply line of the generator 4 trips and a load shedding signal is inputted from the gas turbine controller 50 will be described. In this case, at the pressure setter 40, the supply pressure set value SV2 is set to $P_2$ as shown in FIG. 8.

At the load shedding time, an output command demanding a discharge flow $F_4$ (a minimum flow rate of the fuel by which the combustion of the fuel in the gas turbine 3 can be maintained) as shown in FIG. 8, for example, is inputted into the compressor control unit 30 from the gas turbine controller 50.

At this time, if the opening of the IGV13 is set to 20% as the minimum opening, the compressor 1 will be operated in a surge range beyond the surging line d. But, in the present embodiment, as mentioned above, the higher order selector 36 is supplied with a signal showing the discharge flow manipulation value MV7 for the anti-surging control from the flow controller 38, so that a surge operation of the compressor 1 is prevented.

That is, if the discharge flow decreases to enter the surging range, the discharge flow manipulation value MV7 becomes larger than the recycle valve opening command value MV8 put out from the recycle valve function generator 35. Hence, at the higher order selector 36, the discharge flow manipulation value MV7 is selected as a valve control signal for the recycle valve 14. As the result thereof, the operation on the surging control line e is carried out.

At this time, as the discharge pressure is controlled by the IGV13 so that the supply pressure set value SV2 is equal to $P_2$, the final operation point of the compressor 1 becomes $A_5$. By this setting of the operation point, the compressor 1 is operated so as to prevent the surging.

At the above-mentioned operation point $A_5$, the opening of the IGV13 becomes larger than the minimum opening of 20% and the fuel gas of a flow rate ($F_5$–$F_4$) is recycled via the recycle valve 14.

As mentioned above, according to the compressor control unit of the present first embodiment of the present invention, the gas condition corrector 31 makes corrections to increase or decrease the load command value SV0 corresponding to the fuel gas condition (temperature, inlet pressure, specific gravity, outlet pressure, etc.). Thereby, a rapid and accurate control of the compressor becomes possible so as to correspond to the conditions (temperature, inlet pressure, specific gravity, etc.) of the fuel gas supplied from the fuel gas supply source 5 that variously changes due to the kind of the fuel gas (gas well or gas tank), whether there are other gas-using plants connected in parallel to the fuel gas supply source 5 or not and a gas-using condition thereof, temperature changes by the season, day or night and/or temperature changes due to the fuel gas that is recycled.

Also, not only the IGV13 but also the recycle valve 14 are made use of for the control of the discharge pressure. Thereby, in every operating condition (load shedding time, trip time of the compressor 1 and gas turbine 3, normal operation time, etc.), changes of the discharge pressure of the compressor 1 can be suppressed, that is, a controllability of the discharge pressure can be enhanced.

Moreover, when the valve manipulation correction value MV4 is 50% or more, the command signal for the discharge pressure of the recycle valve 14 is made zero so that the discharge pressure is controlled only by the IGV13. Also, when the valve manipulation correction value MV4 is less than 50%, the IGV13 is maintained to the minimum opening (20%) so that the discharge pressure is controlled only by the recycle valve 14. That is, the IGV13 and recycle valve 14 are both operated in the split range. Thereby, interferences of the discharge pressure controls by the IGV13 and recycle valve 14 can be avoided.

Also, in addition to the feedback control for eliminating the deviation of the discharge pressure, the control for eliminating the deviation of the inlet flow rate and outlet flow rate of the fuel gas for the header tank 12 is carried out so that the discharge pressure is controlled by a combination of the feed-forward control and the feedback control. Thereby, a pressure control gets a high response ability. Hence, even if a sudden load is demanded for the gas turbine 3, changes of the discharge pressure can be suppressed.

Moreover, the recycle valve 14 is selectively applied with a higher order control out of the discharge pressure control and the anti-surging control. Thereby, interferences between these controls also can be avoided.

If the inlet pressure of the compressor 1 changes, by changing the minimum opening of the IGV13 corresponding to this inlet pressure, a more accurate pressure control becomes possible.

Also, in the present first embodiment, while the split point of the IGV13 and recycle valve 14 is set to 50% as shown in FIGS. 10 and 11, the split point is not limited to 50%. That is, as the inclination of the function shown in FIGS. 10 and 11 regulates respective control gains of the IGV13 and recycle valve 14, in order to change these gains, the split point may be changed.

For example, if the split point is made larger than 50%, an acting time of the IGV13 that is short of the response ability can be shortened and also an action stability of the recycle valve 14 that is excellent in the response ability can be enhanced.

In other words, taking account of the dynamic characteristic, etc. of the IGV13 and recycle valve 14, the split point can be appropriately set so that their controllability is enhanced.

Figure 14:
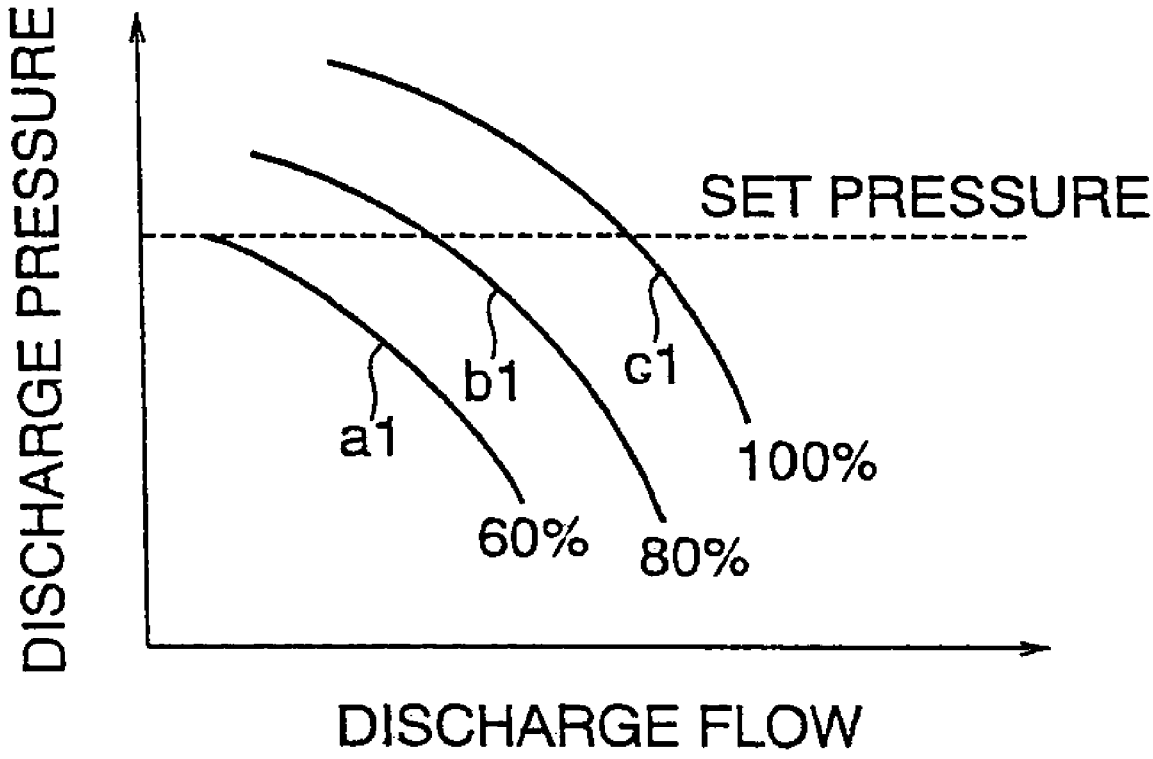
FIG. 14 is a characteristic curve exemplifying a relation between a discharge flow and a discharge pressure, with each speed of the compressor being a parameter, in a second embodiment according to the present invention.
Figure 15:
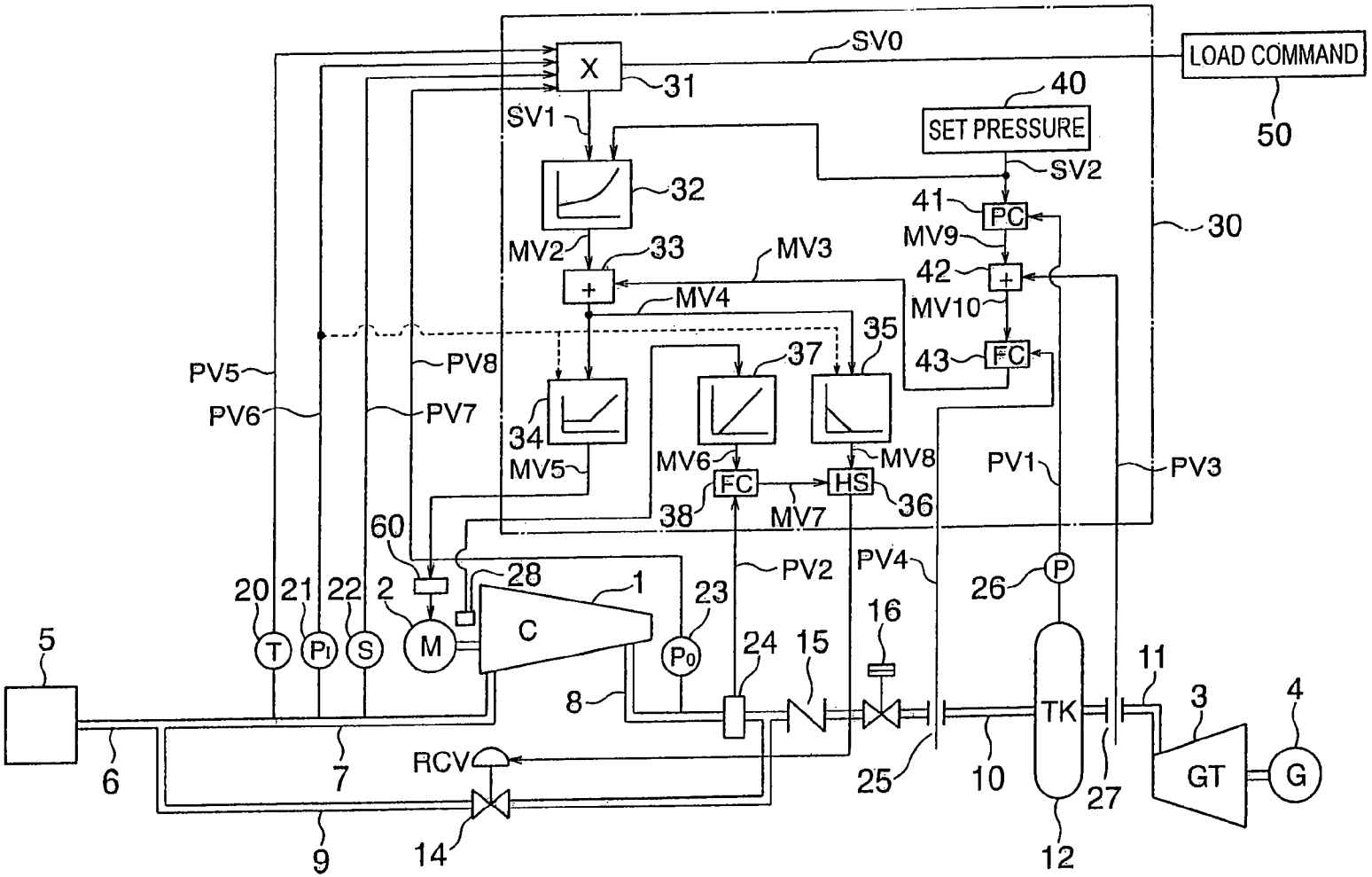
FIG. 15 is a block diagram of a fuel gas compression and supply line and a compressor control unit of the second embodiment.

Next, a second embodiment according to the present invention will be described with reference to FIGS. 14 and 15. FIG. 14 is a characteristic curve exemplifying a relation between the discharge flow and the discharge pressure, with a speed of the compressor being a parameter, in the present second embodiment. FIG. 15 is a block diagram of a fuel gas compression and supply line and a compressor control unit of the second embodiment.

Characteristic curves a1, b1 and c1 as shown in FIG. 14 exemplify a relation between the discharge flow and the discharge pressure of the compressor 1 in the case where the speed of the compressor 1 is set to 60%, 80% and 100%, respectively.

As is clear in contrast with FIG. 8, even if the speed of the compressor 1 is changed in place of the opening of the IGV13, control of the discharge pressure is possible.

In FIG. 15 in which a construction to control the discharge pressure by changing the speed of the compressor 1 is shown, the IGV13 of the first embodiment of the present invention is eliminated and, in place of the operating unit of the IGV, a speed controller 60 of the driver 2, such as a steam turbine, etc., is provided as a flow control device. Also, in place of the valve opening transmitter of the IGV13, a revolution counter 28 that detects the speed of the driver 2 that rotationally drives the compressor 1 is provided.

By the present second embodiment of the present invention also, the same effect as the first embodiment can be obtained.

It is to be noted that, in the second embodiment, while the actual speed of the compressor 1 detected by the revolution counter 28 is inputted into the discharge flow control set value function generator 37, instead thereof, like in the first embodiment, the construction may be made such that the flow control opening command value MV5 put out from the flow control means function generator 34 is inputted into the discharge flow control set value function generator 37.

Figure 16:
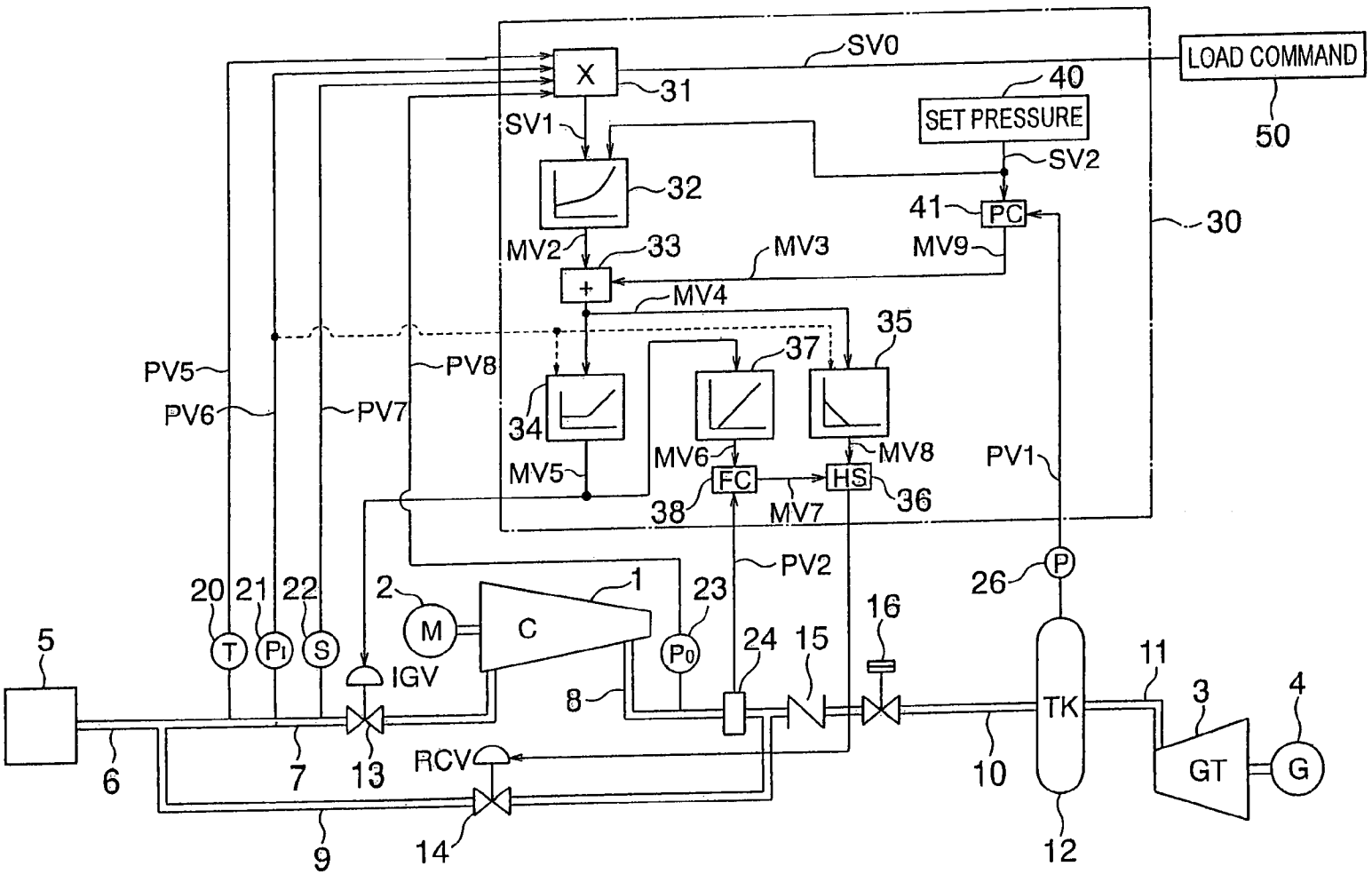
FIG. 16 is a block diagram of a fuel gas compression and supply line and a compressor control unit of a third embodiment according to the present invention.

Next, a third embodiment according to the present invention will be described with reference to FIG. 16. FIG. 16 is a block diagram of a fuel gas compression and supply line and a compressor control unit of the third embodiment.

In the present third embodiment, in contrast with the first embodiment, the header tank supply line flow meter 25 and gas turbine supply line flow meter 27 as well as the adder 42 and flow controller 43 in the compressor control unit 30 are omitted and the pressure manipulation value MV9 from the pressure controller 41 is inputted as it is as the correction manipulation value MV3 into the opening command adder 33.

According to this third embodiment, as the control to eliminate the deviation of the inlet flow rate and outlet flow rate of the fuel gas for the header tank 12 is omitted, while control accuracy thereof becomes slightly lower as compared with the second embodiment, control of the same degree as the first embodiment is possible.

In the present third embodiment also, the construction as shown in FIG. 15 that controls the discharge pressure by operating the speed of the compressor 1 can be applied.

In the above, while the present invention has been described with respect to the first to third embodiments, the present invention is not limited to these embodiments but, needless to mention, may be added with various modifications to the definite construction thereof within the scope of the claims as appended herein.

For example, in a plant comprising a gas-using plant constructed by a single unit of the header tank 2 and a plurality of sets of the gas turbine supply line 11, gas turbine 3 driving the generator 4, etc. as well as comprising a compression and supply source constructed by a plurality of sets of the compressor 1, compressor suction line 7, compressor discharge line 8, recycle line 9 in which the recycle valve 14 is located, header tank supply line 10, compressor control unit 30, various measuring instruments, etc., the same compressor control units 30 as those of the first to the third embodiments of the present invention can be employed.

What is claimed is:

1. A compressor control unit for controlling a compressor that supplies gas into a header tank, comprising:

a pressure setter setting a pressure of said header tank;

a pressure controller comparing a supply pressure measured value measured by a header tank pressure indicator that detects a pressure in said header tank with a supply pressure set value set by said pressure setter to thereby calculate a pressure manipulation value corresponding to a differential pressure as the result of the comparison;

a compression condition corrector measuring a compression condition of the gas and making a correction, corresponding to a measured value as the result of the measurement, to increase or decrease a load command value inputted from outside to thereby calculate a corrected load command value;

a command value function generator being inputted with the corrected load command value calculated by said compression condition corrector to thereby calculate a valve manipulation value;

an opening command adder adding the pressure manipulation value as a correction manipulation value and the valve manipulation value calculated by said command value function generator to thereby calculate a valve manipulation correction value;

a flow control function generator being inputted with the valve manipulation correction value calculated by said opening command adder to thereby calculate a flow control opening command value that increases with an increase of the valve manipulation correction value if the valve manipulation correction value is a predetermined value or more and put out this flow control opening command value as a manipulation signal into an inlet flow control means of said compressor; and a recycle valve function generator receiving the valve manipulation correction value calculated by said opening command adder to thereby calculate a recycle valve opening command value that decreases with the increase of the valve manipulation correction value if the valve manipulation correction value is less than the predetermined value and generate a control signal of a recycle valve located in a recycle line connecting between a suction side and a discharge side of said compressor.

2. A compressor control unit as claimed in claim 1, wherein said compression condition of the gas is measured by an inlet gas temperature indicator provided on an inlet side of said compressor and said compression condition corrector increases or decreases the load command value based on an inlet temperature measured value measured by said inlet gas temperature indicator to thereby calculate the corrected load command value.

3. A compressor control unit as claimed in claim 1, wherein said compression condition of the gas is measured by a gas specific gravity meter provided on an inlet side of said compressor and said compression condition corrector increases or decreases the load command value based on a specific gravity measured value of the gas measured by said gas specific gravity meter to thereby calculate the corrected load command value.

4. A compressor control unit as claimed in claim 1, wherein said compression condition of the gas is measured by an inlet gas pressure indicator provided on an inlet side of said compressor and an outlet gas pressure indicator provided on an outlet side of said compressor and said compression condition corrector increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

5. A compressor control unit as claimed in claim 1, wherein said compression condition of the gas is measured by an inlet gas temperature indicator and a gas specific gravity meter both provided on an inlet side of said compressor and said compression condition corrector increases or decreases the load command value based on an inlet temperature measured value measured by said inlet gas temperature indicator as well as increases or decreases the load command value based on a specific gravity measured value of the gas measured by said gas specific gravity meter to thereby calculate the corrected load command value.

6. A compressor control unit as claimed in claim 1, wherein said compression condition of the gas is measured by an inlet gas temperature indicator and an inlet gas pressure indicator both provided on an inlet side of said compressor as well as is measured by an outlet gas pressure indicator provided on an outlet side of said compressor and said compression condition corrector increases or decreases the load command value based on an inlet temperature measured value measured by said inlet gas temperature indicator and increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

7. A compressor control unit as claimed in claim 1, wherein said compression condition of the gas is measured by a gas specific gravity meter and an inlet gas pressure indicator both provided on an inlet side of said compressor as well as is measured by an outlet gas pressure indicator provided on an outlet side of said compressor and said compression condition corrector increases or decreases the load command value based on a specific gravity measured value of the gas measured by said gas specific gravity meter and increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

8. A compressor control unit as claimed in claim 1, wherein said compression condition of the gas is measured by an inlet gas temperature indicator, an inlet gas pressure indicator and a gas specific gravity meter all provided on an inlet side of said compressor as well as is measured by an outlet gas pressure indicator provided on an outlet side of said compressor and said compression condition corrector increases or decreases the load command value based on an inlet temperature measured value measured by said inlet gas temperature indicator, increases or decreases the load command value based on an inlet pressure measured value measured by said inlet gas pressure indicator and increases or decreases the load command value based on a specific gravity measured value of the gas measured by said gas specific gravity meter as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

9. A compressor control unit as claimed in claim 1, wherein said compressor control unit further comprises an adder adding the pressure manipulation value inputted from said pressure controller and a supply flow rate measured value measured by a supply line flow meter to thereby put out a pressure manipulation correction value as well as comprises a flow controller calculating the correction manipulation value corresponding to a difference between the pressure manipulation correction value and a tank supply flow rate measured value measured by a header tank supply line flow meter and said opening command adder adds the valve manipulation value calculated by said command value function generator and the correction manipulation value inputted from said flow controller to thereby calculate the valve manipulation correction value.

10. A compressor control unit as claimed in claim 1, wherein said inlet flow control means is an inlet guide vane provided at an inlet let of said compressor.

11. A compressor control unit as claimed in claim 1, wherein said inlet flow control means is a speed controller of a driver that rotationally drives said compressor.

12. A compressor control unit as claimed in claim 9, wherein said inlet flow control means is an inlet guide vane provided at an inlet of said compressor.

13. A compressor control unit as claimed in claim 9, wherein said inlet flow control means is a speed controller of a driver that rotationally drives said compressor.

14. A gas turbine power plant, wherein said gas turbine power plant comprises;

a gas supply line connected to a gas supply source, a compressor suction line connected to said gas supply line, an inlet guide vane located in said compressor suction line, a compressor having its inlet side connected to said compressor suction line, a driver driving said compressor, a compressor discharge line connected to an outlet side of said compressor, a recycle line connecting said compressor discharge line and said gas supply line, a recycle valve located in said recycle line, a header tank supply line connected to said compression discharge line, a header tank having its inlet side connected to said header tank supply line a gas turbine supply line connected to an outlet side of said header tank, a gas turbine connected to said gas turbine supply line for driving a generator, and a compressor control unit controlling said compressor, and wherein said compressor control unit comprises;

a pressure setter setting a pressure of said header tank;

a pressure controller comparing a supply pressure measured value measured by a header tank pressure indicator that detects a pressure in said header tank with a supply pressure set value set by said pressure setter to thereby calculate a pressure manipulation value corresponding to a differential pressure as the result of the comparison;

a compression condition corrector measuring a compression condition of the gas and making a correction, corresponding to a measured value as the result of the measurement, to increase or decrease a load command value inputted from outside to thereby calculate a corrected load command value;

a command value function generator being inputted with the corrected load command value calculated by said compression condition corrector to thereby calculate a valve manipulation value;

an opening command adder adding the pressure manipulation value as a correction manipulation value and the valve manipulation value calculated by said command value function generator to thereby calculate a valve manipulation correction value;

a flow control function generator being inputted with the valve manipulation correction value calculated by said opening command adder to thereby calculate a flow control opening command value that increases with an increase of the valve manipulation correction value if the valve manipulation correction value is a predetermined value or more and put out this flow control opening command value as a manipulation signal into an inlet flow control means of said compressor; and a recycle valve function generator receiving the valve manipulation correction value calculated by said opening command adder to thereby calculate a recycle valve opening command value that decreases with the increase of the valve manipulation correction value if the valve manipulation correction value is less than the predetermined value and generate a control signal of said recycle valve located in said recycle line connecting between a suction side and a discharge side of said compressor.

15. A gas turbine power plant as claimed in claim 14, wherein said compression condition of the gas is measured by an inlet gas temperature indicator provided on an inlet side of said compressor and said compression condition corrector increases or decreases the load command value based on an inlet temperature measured value measured by said inlet gas temperature indicator to thereby calculate the corrected load command value.

16. A gas turbine power plant as claimed in claim 14, wherein said compression condition of the gas is measured by a gas specific gravity meter provided on an inlet side of said compressor and said compression condition corrector increases or decreases the load command value based on a specific gravity measured value of the gas measured by said gas specific gravity meter to thereby calculate the corrected load command value.

17. A gas turbine power plant as claimed in claim 14, wherein said compression condition of the gas is measured by an inlet gas pressure indicator provided on an inlet side of said compressor and an outlet gas pressure indicator provided on an outlet side of said compressor and said compression condition corrector increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

18. A gas turbine power plant as claimed in claim 14, wherein said compression condition of the gas is measured by an inlet gas temperature indicator and a gas specific gravity meter both provided on an inlet side of said compressor and said compression condition corrector increases or decreases the load command value based on an inlet temperature measured value measured by said inlet gas temperature indicator as well as increases or decreases the load command value based on a specific gravity measured value of the gas measured by said gas specific gravity meter to thereby calculate the corrected load command value.

19. A gas turbine power plant as claimed in claim 14, wherein said compression condition of the gas is measured by an inlet gas temperature indicator and an inlet gas pressure indicator both provided on an inlet side of said compressor as well as is measured by an outlet gas pressure indicator provided on an outlet side of said compressor and said compression condition corrector increases or decreases the load command value based on an inlet temperature measured value measured by said inlet gas temperature indicator and increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

20. A gas turbine power plant as claimed in claim 14, wherein said compression condition of the gas is measured by a gas specific gravity meter and an inlet gas pressure indicator both provided on an inlet side of said compressor as well as is measured by an outlet gas pressure indicator provided on an outlet side of said compressor and said compression condition corrector increases or decreases the load command value based on a specific gravity measured value of the gas measured by said gas specific gravity meter and increases or decreases the load command value based on an inlet pressure measured value measured by said inlet gas pressure indicator as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

21. A gas turbine power plant as claimed in claim 14, wherein said compression condition of the gas is measured by an inlet gas temperature indicator, an inlet gas pressure indicator and a gas specific gravity meter all provided on an inlet side of said compressor as well as is measured by an outlet gas pressure indicator provided on an outlet side of said compressor and said compression condition corrector increases or decreases the load command value based on an inlet temperature measured value measured by said inlet gas temperature indicator, increases or decreases the load command value based on an inlet pressure measured value measured by said inlet gas pressure indicator and increases or decreases the load command value based on a specific gravity measured value of the gas measured by said gas specific gravity meter as well as increases or decreases the load command value based on a pressure ratio of the inlet pressure measured value measured by said inlet gas pressure indicator and an outlet pressure measured value of the gas measured by said outlet gas pressure indicator to thereby calculate the corrected load command value.

22. A gas turbine power plant as claimed in claim 14, wherein said compressor control unit further comprises an adder adding the pressure manipulation value inputted from said pressure controller and a supply flow rate measured value measured by a supply line flow meter to thereby put out a pressure manipulation correction value as well as comprises a flow controller calculating the correction manipulation value corresponding to a difference between the pressure manipulation correction value and a tank supply flow rate measured value measured by a header tank supply line flow meter and said opening command adder adds the valve manipulation value calculated by said command value function generator and the correction manipulation value inputted from said flow controller to thereby calculate the valve manipulation correction value.

23. A gas turbine power plant as claimed in claim 14, wherein said inlet flow control means is an inlet guide vane provided at an inlet of said compressor.

24. A gas turbine power plant as claimed in claim 14, wherein said inlet flow control means is a speed controller of the driver that rotationally drives said compressor.

25. A gas turbine power generating plant as claimed in claim 22, wherein said inlet flow control means is an inlet guide vane provided at an inlet of said compressor.

26. A gas turbine power generating plant as claimed in claim 22, wherein said inlet flow control means is a speed controller of the driver that rotationally drives said compressor.

* * * * *